US007367256B2

(12) United States Patent
Fatemi et al.

(10) Patent No.: US 7,367,256 B2
(45) Date of Patent: May 6, 2008

(54) PRESSURE SWITCH CONTROL FOR ATTACHMENT COUPLING SYSTEM

(75) Inventors: Ray S. Fatemi, Copley, OH (US); Paul M. Molnar, Hinckley, OH (US)

(73) Assignee: JRB Attachments, LLC, Cedar Rapids, IA (US)

( * ) Notice: Subject to any disclaimer, the term of this patent is extended or adjusted under 35 U.S.C. 154(b) by 117 days.

(21) Appl. No.: 11/438,554

(22) Filed: May 22, 2006

(65) Prior Publication Data

US 2007/0130932 A1 Jun. 14, 2007

Related U.S. Application Data

(63) Continuation-in-part of application No. 10/770,316, filed on Feb. 2, 2004, now Pat. No. 7,047,866.

(60) Provisional application No. 60/443,942, filed on Jan. 31, 2003, provisional application No. 60/496,509, filed on Aug. 20, 2003.

(51) Int. Cl.
*F01B 25/12* (2006.01)
*F15B 13/04* (2006.01)

(52) U.S. Cl. ..... 91/432; 91/1

(58) Field of Classification Search ..... 91/1, 91/420, 432

See application file for complete search history.

(56) References Cited

U.S. PATENT DOCUMENTS

| | | | | |
|---|---|---|---|---|
| 4,850,790 | A | 7/1989 | Johnson et al. | |
| 4,953,592 | A | 9/1990 | Takahashi et al. | |
| 5,147,173 | A | 9/1992 | Fauber et al. | |
| 5,966,850 | A | 10/1999 | Horton | |
| 6,266,960 | B1 | 7/2001 | Bibb et al. | |
| 6,502,600 | B2 | 1/2003 | Ennemark et al. | |
| 6,964,122 | B2 * | 11/2005 | Cunningham et al. | 37/468 |
| 7,047,866 | B2 * | 5/2006 | Fatemi et al. | 91/432 |
| 2003/0204972 | A1 | 11/2003 | Cunningham et al. | |

FOREIGN PATENT DOCUMENTS

| | | |
|---|---|---|
| EP | 1 318 242 A2 | 6/2003 |

* cited by examiner

*Primary Examiner*—Michael Leslie
(74) *Attorney, Agent, or Firm*—Fay Sharpe LLP

(57) ABSTRACT

An attachment control system includes an electrical control system and hydraulic control system. The electrical control system interfaces with the hydraulic control system to ensure that attachment decoupling in response to operator electrical control can occur only when at least one hydraulic threshold condition is satisfied as indicated by a hydraulic pressure sensor. Attachment decoupling is prevented unless the pressure sensor outputs an electrical signal that indicates that the attachment is safely positioned (e.g., full-extend or full-curl). In one example, this is indicated with the attachment positioning cylinder is pressurized above a select threshold as indicated by a pressure sensor.

18 Claims, 18 Drawing Sheets

PRESSURE SWITCH CONTROL FOR ATTACHMENT COUPLING SYSTEM

CROSS-REFERENCE TO RELATED APPLICATIONS

This application is a continuation-in-part of U.S. application Ser. No. 10/770,316 filed Feb. 2, 2004, now U.S. Pat. No. 7,047,866 which claims benefit of the filing date of U.S. provisional patent application Ser. No. 60/443,942 filed Jan. 31, 2003 and U.S. provisional patent application Ser. No. 60/496,509 filed Aug. 20, 2003, and these prior applications are each hereby expressly incorporated by reference.

BACKGROUND

Construction attachment coupling systems and control systems for same are well known in the art. Safety is a primary concern for such systems and, in particular, such systems include means for preventing accidental decoupling of a bucket or other attachment as could lead to injury to those nearby. Another primary concern for such system is ease of use for operators. In many respects, safety and ease of use go hand-in-hand because a system that is easy for operators to use and understand is more likely to be used in a safe manner according to manufacturer instructions.

The present invention provides a new and improved electrical control system and/or a new and improved hydraulic control system for attachment coupling systems that enhances both safety and ease of use. While the electrical and hydraulic control systems are described herein as a combined system, each of these systems can be used independent of the other without departing from the overall scope and intent of the present invention.

SUMMARY

In accordance with a first aspect of the present development, a hydraulic control circuit for an attachment coupling system includes an input flow path for receiving a supply of pressurized fluid, and first and second actuator flow paths for supplying fluid to respective first and second input/output locations of a first hydraulic actuator associated with an attachment coupler. A return flow path is included for supplying pressurized fluid to a reservoir. A first control valve is connected to the input flow path, the return flow path, and the first and second actuator flow paths. The first control valve is selectively positionable in at least first and second states in response to a first electrical control signal wherein: (i) in the first state, the first control valve connects the input flow path to the first actuator flow path and connects the return flow path to the second actuator flow path; and, (ii) in the second state, the first control valve connects the input flow path to the second actuator flow path and connects the return flow path to the first actuator flow path. The hydraulic control circuit further includes a pressure sensor for sensing fluid pressure supplied to an associated attachment positioning cylinder. The pressure sensor is adapted to output an electrical pressure signal that changes state when the fluid pressure supplied to the associated attachment positioning cylinder exceeds a safety threshold. An electronic control system is operatively connected to the pressure sensor and the first control valve. The electronic control system outputs the first control signal to the first control valve to change the first control valve from the first state to the second state only after the electrical pressure signal output by the pressure sensor to the electronic control system indicates that the safety threshold is satisfied.

In accordance with another aspect of the present development, a method for controlling an attachment coupling system includes pressurizing a first hydraulic actuator of an attachment quick coupler with hydraulic fluid in a first orientation to engage an attachment coupling mechanism connected to the hydraulic actuator. The method further includes sensing hydraulic pressure in a second hydraulic actuator that is used to position the attachment quick coupler. The method also includes pressurizing the first hydraulic actuator with hydraulic fluid in a second orientation that is opposite said first orientation to disengage the attachment coupling mechanism connected to the hydraulic actuator only after the hydraulic pressure in the second hydraulic actuator satisfies a threshold pressure value.

BRIEF DESCRIPTION OF THE DRAWINGS

The invention comprises various components and arrangements of components, and comprises various steps and arrangements of steps, preferred embodiments of which are illustrated in the accompanying drawings that form a part hereof and wherein.

DETAILED DESCRIPTION

Figure 1A:
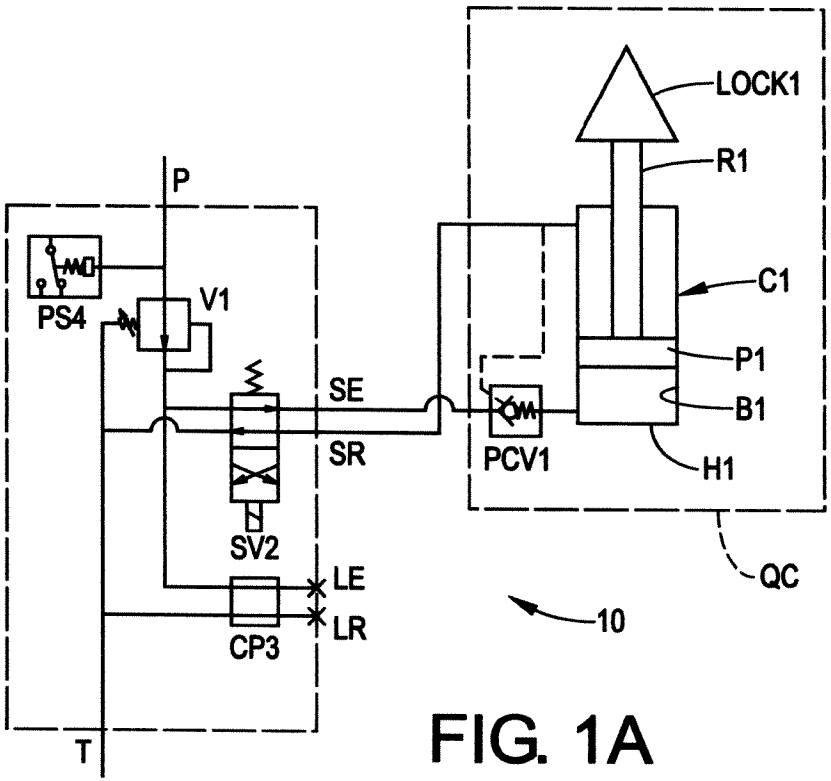
FIG. 1A is a schematic diagram of a hydraulic circuit for controlling a single hydraulic cylinder or other hydraulic actuator in accordance with the present invention.
Figure 1B:
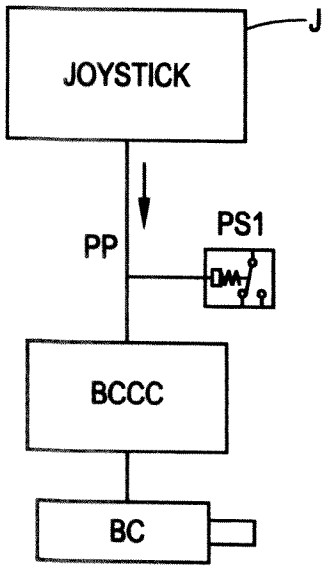
FIG. 1B is a schematic diagram of a joystick pilot pressure control circuit.
Figure 1C:
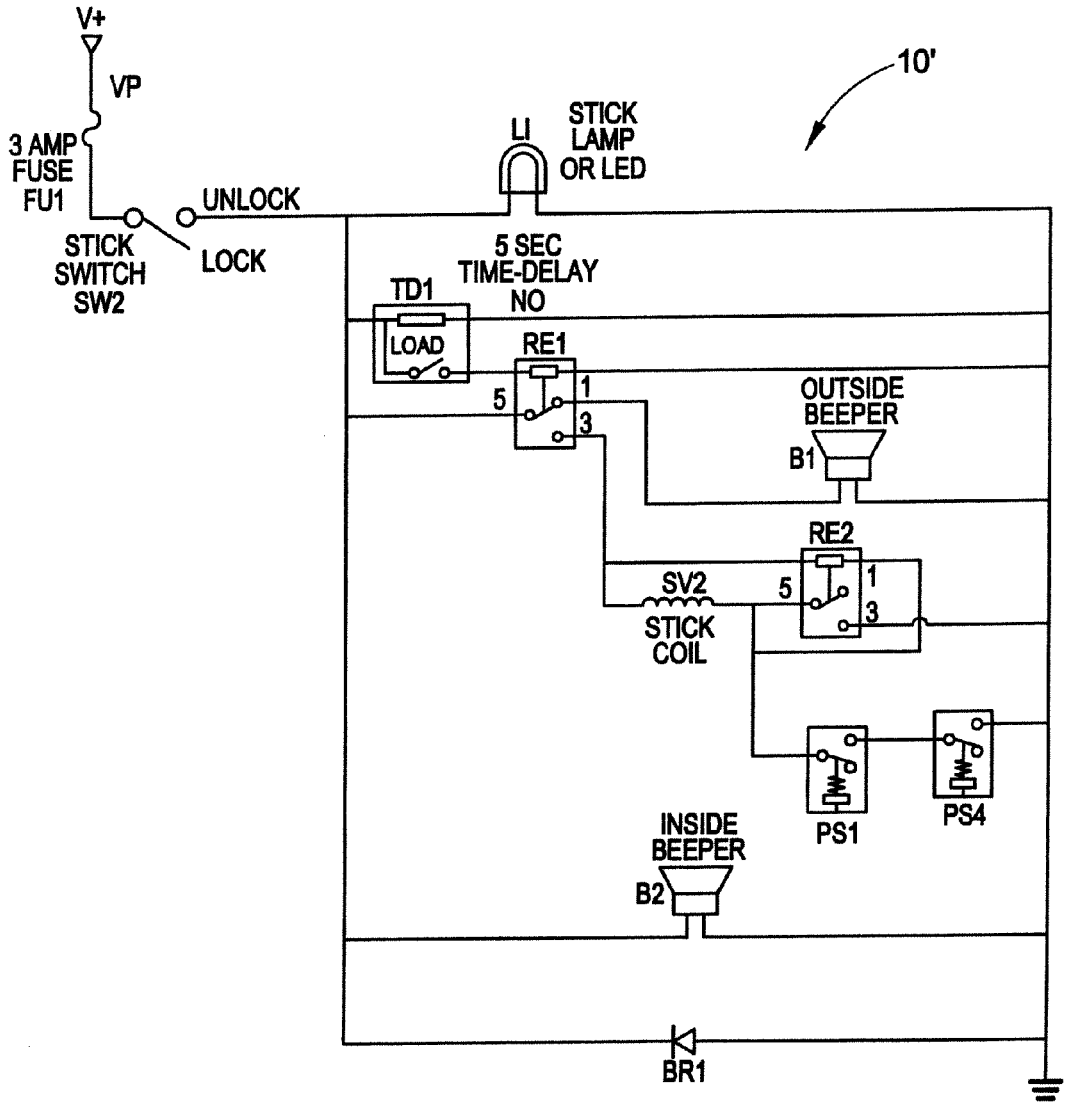
FIG. 1C is a schematic diagram of an electrical circuit for controlling a single-actuator hydraulic circuit (such as that shown in FIG. 1A) in accordance with the present invention.

Referring now to FIGS. 1A-1C of the drawings, a hydraulic circuit 10 for controlling a single hydraulic actuator such as a motor or cylinder C1 in accordance with the present invention is shown. As shown, the cylinder C1 is provided as part of an attachment quick coupler QC used to engage spaced-apart parallel pins or other structure of an excavator bucket or other attachment. The cylinder C1, itself, is conventional in all respects and can be provided as a part of or separate from the circuit 10. The cylinder C1 comprises a housing H1 defining a bore B1, and a piston P1 is closely and slidably received in the bore B1. A rod R1 is connected to and moves together with the piston P1, and the position of the piston P1 in the bore B1 is controlled by variation of the hydraulic pressure on opposite sides of the piston P1 in the bore B1. The circuit 10 (not including the cylinder C1) can be defined by discrete components connected by hydraulic lines but is preferably defined as a block or manifold M including the various flow paths drilled or otherwise defined therein and including valve cartridges and the like connected thereto.

First and second hydraulic actuator fluid flow paths (such as drilled flow paths, hydraulic hoses/lines and/or any other suitable flow paths or conduits) SR,SE are connected to output/input fittings of the cylinder housing H1 in fluid communication with the bore B1 and communicate hydraulic fluid into and out of the bore B1 on opposite sides of the piston P1 to control the difference in pressure on opposite sides of the piston P1 and, thus, the position of the piston P1 in the bore B1. In a typical arrangement, "extension" of the piston P1 so that the rod R1 extends farther out of the housing corresponds to a "locked" condition of the coupling system; retraction of the piston P1 and rod R1 corresponds to an "unlocked" condition of the coupling system. In some quick coupler structures, the rod R1 is connected to a wedge or other lock member that selectively captures an attachment pin (or other part of the attachment) to the coupler QC depending upon extension/retraction of the rod R1 to provide locking/unlocking for the quick coupler QC. In other coupler structures, the cylinder C1 is used to spread opposed hooks of the coupler apart for attachment coupling/locking operations or draw the hooks together for attachment unlocking/decoupling operations to provide locking/unlocking operations for the quick coupler QC.

A pilot check valve PCV1 is included and is operatively connected between to the paths SR,SE to prevent flow of fluid out of the bore B1 via path SE unless the path SR is pressurized above a select pilot check threshold. This arrangement prevents the piston P1 and rod R1 from retracting unless the path SR is actively pressurized, i.e., fluid cannot flow from the bore B1 via path SE as required to retract the piston P1 and rod R1 unless the path SR is positively pressurized to open the pilot check valve PCV1 to reduce the likelihood of accidental retraction of the piston P1 and rod R1 upon the path SE being unexpectedly opened due to a broken hose or the like.

Hydraulic fluid is supplied continuously to the circuit 10 under pressure via pressure input path P from a pump (not shown) that draws from the reservoir or tank (not shown). Fluid is returned to the reservoir/tank via return path T. At least one joystick J or other actuator positioning device (e.g., levers, foot pedals, etc.) is used by an operator to control fluid flow to an attachment positioning actuator or cylinder (also referred to as a bucket cylinder) BC used to extend (roll-back) and curl a bucket or otherwise maneuver an attachment that is operatively coupled to the excavator, backhoe or other machine on which circuit 10 is employed. As is generally known, the control device J outputs a varying pilot pressure of hydraulic fluid in a pilot pressure path PP depending upon its position as maneuvered by an operator to control both direction and speed of motion of the bucket cylinder BC. This pilot pressure in path PP is input to a bucket cylinder control circuit BCCC that drives the bucket cylinder BC. As is also known to those of ordinary skill in the art, extension of the bucket cylinder causes curling of the bucket or other attachment, while retraction of the bucket cylinder causes extension or roll-back of the bucket or other attachment. The pump typically pressurizes the pressure input path P to an input pressure of 4000-6000 pounds per square inch (psi). A pressure control vale V1 receives the path P as input and outputs hydralic fluid at a select operating pressure, preferably in the range of about 3000 psi-3500 psi (but this can vary) in the path SE.

The paths SR,SE are each in communication with a first electro-mechanical fluid flow control valve such as solenoid valve SV2. In a normal, non-actuated condition, the solenoid valve SV2 connects the path SR to the return path T and connects the path SE to the output of pressure reducing valve V1. As such, in this normal state, the hydraulic fluid output via valve V1 at a select operating pressure is communicated through solenoid valve SV2 and path SE to the extend side of the piston P1. At the same time, the path SR is in communication with the return path T via solenoid valve SV2 so that the retract side of the piston P1 can exhaust to the tank. Therefore, in this state, the pressure difference in paths SR,SE will result in the extension of the piston P1 and rod R1 which, as noted, typically corresponds to a "locked" condition for an associated locking mechanism LOCK1 that is operably coupled to or otherwise controlled by position of rod R1. This continuous pressurizing of the path SE is a safety consideration owing to the fact that the coupling system lock LOCK1 actuated by the cylinder C1 is configured to be engaged (and thus operatively retain a bucket or other attachment) when the piston P1 and rod R1 are extended.

Retraction of the piston P1 to disengage the associated lock LOCK1 as required to de-couple a bucket or other attachment requires sufficient pressurization of the path SR to move the piston P1 and also to open the pilot check valve PCV1 to allow exhaust flow from the bore B1 in path SE. In general, this state is established by energizing a coil of the solenoid valve SV2 so that the solenoid valve is actuated, i.e., the spool thereof is "shifted," to establish cross-flow between the paths SR and SE which, in turn, causes the operating flow output from the pressure control valve V1 to be directed to the path SR instead of the path SE and causes the path SE to be connected in fluid communication to the return path T. This actuated or shifted or energized state of the solenoid valve SV2 leads to retraction of the piston P1 and rod R1 and unlocking of an associated lock connected thereto as required for attachment decoupling operations.

Because retraction of the piston P1 and rod R1 connected thereto results in retraction or other disengagement of a lock LOCK1 operatively connected to the rod R1 which, in turn, allows for de-coupling of an associated attachment such as a bucket, blade or the like from the quick coupler QC of which the cylinder C1 is a part, it is important to ensure that the path SR be pressurized for retraction of the piston P1 and opening of the pilot check valve PCV1 and that the path SE flow to the reservoir tank via return path T only upon at least both of the following two conditions being met:

(i) the pressure in the input path P must be over a select maximum "trigger" value for a sustained period, wherein the trigger value is set to a select percentage of the "over-relief" pressure that occurs when the bucket or other attachment is physically unable to pivot further in at least one direction under maximum available hydraulic pressure (i.e., the attachment is in either the full-curl or full-extend position); and, (ii) predetermined and sustained operator manipulation of a control device (typically a joystick) J in a manner that indicates the operator has intentionally moved (or attempted to move) the bucket or other attachment to the required attachment decoupling position (i.e., full-curl or full-extend).

Satisfaction of the first condition (i) of a select trigger pressure indicates that the bucket or other associated attachment to be decoupled is likely in a full-curl or full-extend (roll-back) position as required for safe decoupling. Satisfaction of the second condition (ii) indicates that the operator has intentionally moved the bucket or other attachment to the required decoupling position (full-curl or full-extend as appropriate) and that the satisfaction of the first condition (i.e., the select trigger pressure) has not resulted from another condition as could occur during certain operative conditions, e.g., digging in a rocky area or from use of other segments of the excavator or other machine. Thus, with both conditions (i) and (ii) satisfied, it is known that the attachment has been moved intentionally to the required decoupling position, which can be either full-curl or full-extend by extending and retracting the bucket cylinder, respectively.

To determine if the first condition is satisfied, i.e., (i) presence of the select trigger pressure in input path P, the circuit 10 comprises a first pressure switch PS4 in communication with the input path P. When the pressure in input path P meets or exceeds the select trigger pressure the first pressure switch PS4 is actuated. In the illustrated embodiment, the first pressure switch PS4 is a normally open switch and closes when the pressure in input path P reaches or exceeds the select trigger pressure. In one embodiment, the trigger is set to 85%-90% of the over-relief pressure for a particular machine. The pressure magnitude required to actuate first pressure switch PS4 can be fixed or adjustable.

To determine if the second condition (ii) is satisfied, i.e., to determine if there exists predetermined and sustained operator manipulation of a joystick J or other control device in a manner that indicates the operator has intentionally moved (or attempted to move) the bucket or other attachment to the required decoupling position, a second pressure switch PS1 is provided as part of circuit 10 (see FIG. 1B that shows a pilot pressure control circuit portion of circuit 10) and is connected in fluid communication with a pilot pressure path PP output by joystick J. When the joystick J is manipulated to either the full-curl or full-extend position, the pressure in the pilot pressure path PP output by joystick is sufficient to actuate the switch PS1. In the illustrated embodiment, the second pressure switch PS1 is a normally open switch that closes when the hydraulic pressure in pilot path PP exceeds a select threshold. The pressure magnitude required to actuate second pressure switch PS1 can be fixed or adjustable.

The first and second pressure switches PS4,PS1 form a part of both the hydraulic circuit 10 and the electrical control circuit 10' (see FIG. 1C) that is suitable for controlling the hydraulic circuit 10, in particular the solenoid valve SV2 thereof, for attachment coupling/de-coupling operations. In this manner, the state of the switches PS4,PS1 is used to control actuation of the solenoid valve SV2 of hydraulic circuit 10. The electrical circuit 10' is constructed using hard-wired components and/or using a printed circuit. The components can be electro-mechanical devices or solid-state devices, microprocessors and/or any other suitable and convenient means including software and the like.

The circuit 10' of FIG. 1C is intended to ensure that the rod and piston R1,P1 of cylinder C1 are held in the retracted position after being retracted so that the lock LOCK1 controlled thereby remains "unlocked" for a sufficient time to allow for decoupling operations. As shown in FIG. 1C, a DC operating voltage V+ is supplied by way of a voltage input path VP to a switch SW2 located in the operator cab. The switch SW2 is a simple toggle switch or can be a more advanced switching system including a microprocessor or the like that allows for sophisticated control of switch activation and associated features. For example, use of a microprocessor allows for use of electronic push-buttons that must be pressed and held for sufficient duration (e.g. 1-3 seconds) before closing of switch SW2 to prevent accidental actuation. In one preferred embodiment, the switch SW2 is a safety toggle switch that requires two-stage manipulation by an operator to prevent opening and/or closing by simple bumping or the like, e.g., a detent-toggle switch that requires upward pulling on the switch lever combined with pivoting of the lever. A key lock-out can also be provided to prevent movement of switch SW2 absent use of a mating key.

When the switch SW2 is opened, the coil of the solenoid valve SV2 is de-energized due to the open circuit relative to voltage source V+. When the switch SW2 is closed, current flows through an indicator lamp or LED or the like L1 located in the operator'scab so that the operator receives a visual indication that the switch SW2 is closed. Closing of the switch SW2 also results in current flow through an audible buzzer/beeper B2 located inside the operator's cab so that the operator receives an audible indication that the switch SW2 is closed.

Furthermore, when the switch SW2 is closed, current flows to a timer TD1 and through relay RE1 to a beeper/buzzer B1 located outside the operator's cab to warn workers and others that the switch SW2 is closed (i.e., that a de-coupling operation is being carried out).

After a select delay (e.g., 5 sec.) according to the parameters of timer TD1, the timer TD1 latches so that a switching current also flows to relay RE1 and causes relay to switch from a first conductive state (as shown with terminals 5-1 connected) to a second conductive state (in which terminals 5-3 are connected). In the second conductive state of relay RE1, the outside beeper B1 is de-energized. If, at the same time, the first and second hydraulic pressure switches PS4, PS1 are closed (i.e., conditions (i) and (ii) above are satisfied), the circuit between the voltage source V+ and ground is complete and the coil of solenoid valve SV2 is energized to actuate or shift the solenoid valve SV2 as described above in relation to FIG. 1A so that cross-flow is established in paths SR,SE causing retraction of piston P1. This current flow through coil of solenoid valve SV2 provides a switching current to relay RE2 that causes relay RE2 to switch from a first conductive state, with terminals 5-1 connected, to a second conductive state, with terminals 5-3 connected. When the relay RE2 is in its second conductive state, the pressure switches PS1,PS4 are bypassed so that if either or both of these switches opens, the coil of valve SV2 remains energized. This is required to ensure that the rod and piston R1,P1 of cylinder C1 stay retracted while an operator maneuvers the coupling device in an effort to couple to or decouple from an attachment even though conditions (i) and/or (ii) above would become unsatisfied during this coupling/decoupling procedure. When the operator opens switch SW2, current flow through coil of valve SV2 ceases so that the rod and piston R1,P1 of cylinder C1 are extended and so that relay RE2 resets to its normal first conductive state as shown in FIG. 1C. When relay RE2 resets, pressure switches PS1,PS4 are once again placed back into the circuit path between coil of valve SV2 and ground. The diode BR1 is provided as a circuit protection device to prevent damage to the lamp L1 and other circuit components.

The first and second pressure switches PS4,PS1 form a part of both the hydraulic circuit 10 and the electrical control circuit 10'. The state of the switches PS4,PS1 is used to control initial actuation of the solenoid valve SV2 but are then effectively removed from the circuit by relay RE2 to allow for coupling/decoupling operations. The electrical circuit 10' is constructed using hard-wired components and/or using a printed circuit. The components can be electro-mechanical devices or solid-state devices, microprocessors and/or any other suitable and convenient means and combinations of same.

Those of ordinary skill in the art will recognize from the foregoing that the sound of the outside warning buzzer/beeper B1 combined with the delay of, e.g., 5 sec., provides those located near the excavator or other machine with sufficient warning of attachment decoupling prior to the coil of the solenoid valve SV2 being energized to initiate decoupling operations.

Figure 2A:
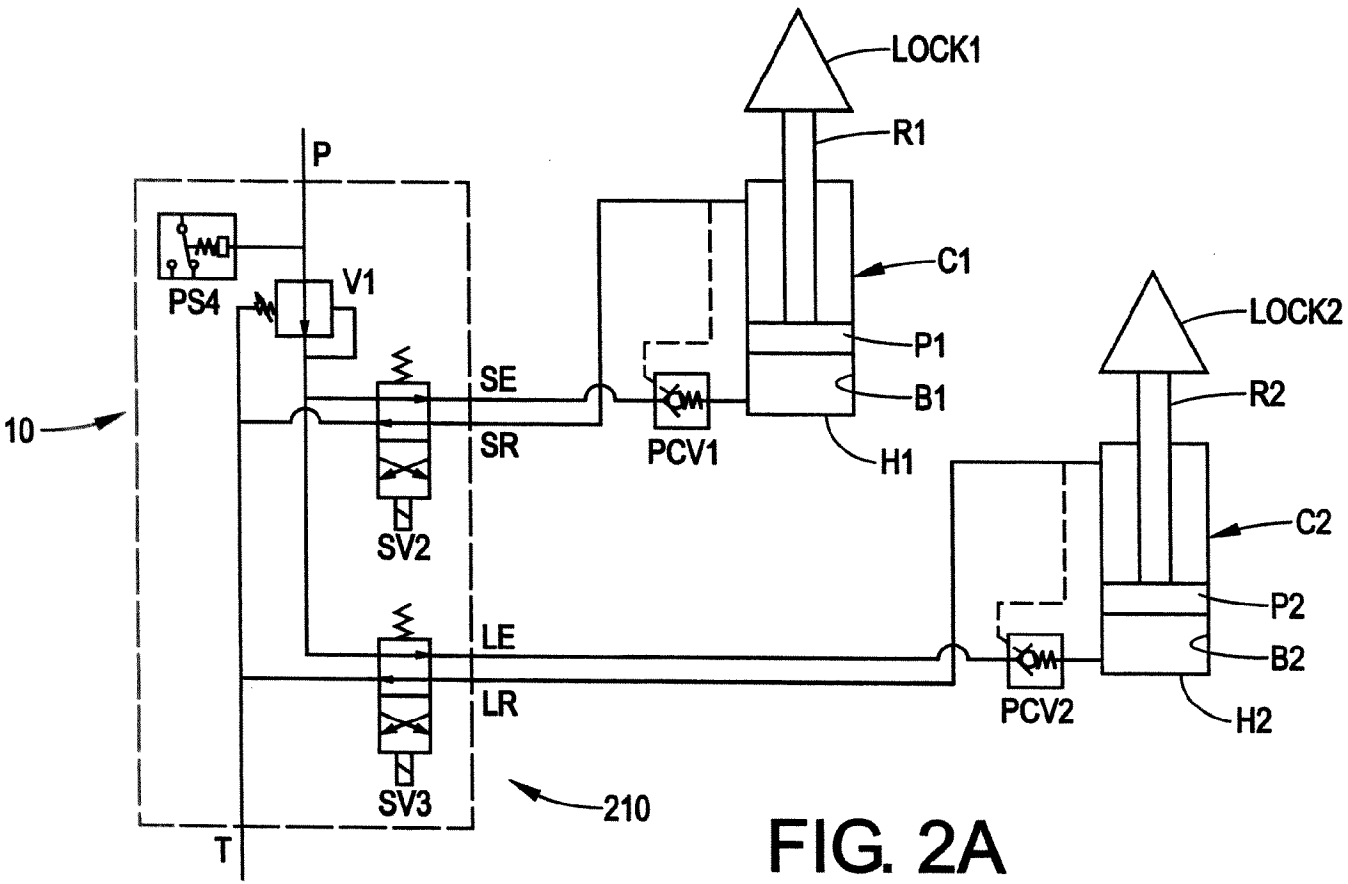
FIG. 2A is a schematic diagram of a hydraulic circuit for controlling a two-actuator hydraulic circuit in accordance with the present invention.

FIG. 2A illustrates the hydraulic circuit 10 shown in FIG. 1A and further illustrates a secondary hydraulic circuit operably connected thereto so as to define a hydraulic circuit 210 suitable for controlling first and second hydraulic actuators such as, e.g., cylinders C1,C2, in accordance with the present invention. The cylinders C1,C2 can be provided as a part of the circuit 210, but are typically provided as separate components.

Further discussion of the circuit portion 10 for controlling cylinder C1 is not provided here (see discussion of circuit 10 above in relation to FIG. 1A). As described below, other portions of circuit 210 control the cylinder C2, and relevant portions of the above disclosure relating to the circuit 10 also apply to the circuit 210 unless otherwise noted. In a typical arrangement, the rod R1 of the first cylinder C1 is operably coupled to and controls a first pin locking/capturing mechanism LOCK1 of an attachment coupling system, while the rod R2 of the second cylinder C2 is operatively coupled to and controls a second pin locking/capturing mechanism LOCK2 of the attachment coupling system. The first pin locking mechanism is typically used to capture the attachment to an arm or "dipper" stick while the second pin locking mechanism is used to capture the attachment to a control link. As such, the first pin locking mechanism LOCK1 is typically the first to be locked during attachment coupling operations and the last to be unlocked during attachment de-coupling operations.

The cylinders C1,C2 are typically structurally similar or identical and, thus, the cylinder C2 comprises a housing H2, bore B2, piston P2 and rod R2. As discussed above in relation to the cylinder C1, extension of piston P2 and rod R2 so that the rod extends out of the housing H2 a greater amount typically corresponds to a "locked" condition for the second locking mechanism connected thereto; retraction of the piston P2 and rod R2 so that the length of rod R2 extending out of the cylinder C2 is shortened corresponds to an "unlocked" condition of the second locking mechanism connected thereto.

In addition to the circuit portion 10, the circuit 210 further comprises a second pilot check valve PCV2 and a second electro-mechanical fluid flow control valve such as a solenoid valve SV3. Hydraulic actuator fluid flow paths (such as drilled flow paths, hydraulic hoses/lines and/or any other suitable flow paths of conduits) LR,LE are connected to the cylinder input/output fittings of housing H2 in fluid communication with the bore B2 and communicate hydraulic fluid into and out of the bore B2 on opposite sides of the piston P2 to control the difference in pressure on opposite sides of the piston P2 and, thus, the position of the piston P2 in the bore B2.

A pilot check valve PCV2 is included and is operatively connected between to the paths LR,LE to prevent flow of fluid out of the bore B2 via path LE unless the path LR is pressurized above a select pilot check threshold. This arrangement prevents the piston P2 and rod R2 from retracting unless the path LR is actively pressurized, i.e., fluid cannot flow from the bore B2 via path LE as required to retract the piston P2 and rod R2 unless the path LR is positively pressurized to open the pilot check valve PCV2 to reduce the likelihood of accidental retraction of the piston and rod upon the path LE being unexpectedly opened due to a broken hose or the like.

As noted above, hydraulic fluid is supplied continuously to the circuit 210 under pressure via pressure input path P and a pressure control valve V1 receives the path P as input and outputs hydraulic fluid at a select operating pressure, in the range of about 3000 psi-3500 psi or any other desired pressure range. Like path SE, the path LE is also in communication with the output of the valve V1 to receive the operating flow therefrom.

The paths LR,LE are each in communication with the solenoid valve SV3. In a normal, non-actuated or non-energized condition, the solenoid valve SV3 connects the path LR to the return path T and connects the path LE to the output of pressure reducing valve V1. As such, in this state, the hydraulic fluid output via valve V1 at a select operating pressure is communicated through solenoid valve SV3 and path LE to the extend side of the piston P2. At the same time, the path SR is in communication with the return path T via solenoid valve SV3 so that the retract side of the piston P2 can exhaust to the reservoir tank via path T. In this state, the pressure difference in paths LR,LE will result in the extension of the piston P2 and rod R2 which, as noted, typically corresponds to a "locked" condition for an associated locking mechanism that is operably coupled to or otherwise controlled by position of rod. This continuous pressurizing of the path LE is another safety consideration owing to the fact that the coupling system lock actuated by the cylinder C2 is configured to be engaged (and thus operatively retain a bucket or other attachment) when the piston P2 and rod R2 are extended.

Retraction of the piston P2 to disengage the associated lock as required to release a bucket or other attachment requires sufficient pressurization of the path LR to move the piston P2 and also to open the second pilot check valve PCV2 to allow exhaust flow from the bore B2 in path LE. In general, this state is established by energizing the solenoid valve SV3 which, when energized or actuated, i.e., when the spool thereof is "shifted," establishes cross-flow between the paths LR and LE so that the operating flow output from the pressure control valve V1 is directed to the path LR instead of the path LE and so that the path LE is connected in fluid communication to the return path T. This, in turn, leads to retraction of the piston P2 and rod R2 and unlocking of an associated lock connected thereto as required for attachment decoupling operations.

Because retraction of the piston P2 and rod R2 results in retraction or other opening of a lock operatively connected to the rod which, in turn, allows for de-coupling of an associated attachment such as a bucket, blade or the like, it is important to ensure that the path LR is pressurized for retraction of the piston P2 and opening of the pilot check valve PCV2 and that the path LE flows to the reservoir tank via return path T only upon both of the following two conditions being met for the reasons discussed above:

(i) the pressure in the input path P must be over a select maximum "trigger" value for a sustained period, wherein the trigger value is a select percentage of the over-relief pressure that occurs when the bucket or other attachment is physically unable to pivot further in at least one direction under maximum available hydraulic pressure (i.e., the attachment is in either the full-curl or full-extend position); and, (ii) predetermined and sustained operator manipulation of a control device (typically a joystick) J in a manner that indicates the operator has intentionally moved (or attempted to move) the bucket or other attachment to the required attachment decoupling position (i.e., full-curl or full-extend).

The pressure switches PS4,PS1 (see also FIG. 1C) form part of the circuit 210 and operate as described above to determine if these two conditions are satisfied.

Figure 2B:
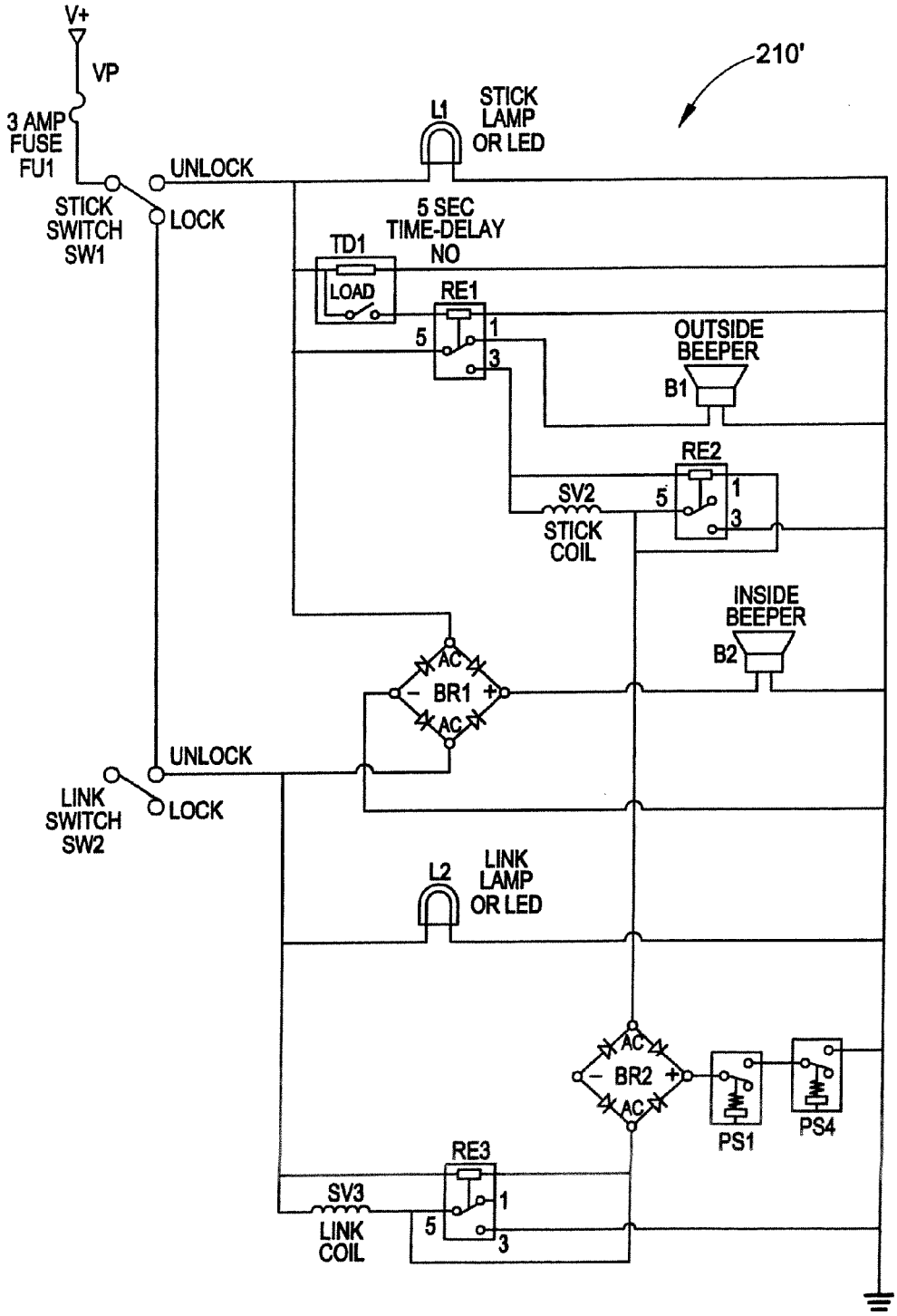
FIG. 2B is a schematic diagram of an electrical circuit for controlling a two-actuator hydraulic circuit in accordance with the present invention.

FIG. 2B illustrates an electronic control circuit 210' also suitable for controlling the hydraulic circuit 210. The first and second pressure switches PS4,PS1 form a part of both the hydraulic circuit 210 and the electrical control circuit 210'. The state of the switches PS4,PS1 is used to control actuation of the solenoid valves SV2,SV3 of hydraulic circuit 210. The electrical circuit 210' is constructed using hard-wired components and/or using a printed circuit. The components can be electro-mechanical devices or solid-state devices, microprocessors and/or any other suitable and convenient means.

As shown in FIG. 2B, DC operating voltage V+ is supplied to a switch SW1 located in the operator cab via path VP. The switch SW1 is preferably a double-pole, single-throw switch that is normally in the "lock" position. In this "lock" position, the switch SW1 completes a circuit between the voltage source V+ and the switch SW2. When the switch SW1 is moved to the "unlock" position, it opens the circuit between the voltage source V+ and the switch SW2. Consequently, it is impossible for the coils both solenoid valves SV2,SV3 of hydraulic circuit 210 to be energized for unlocking operations at the same time. This is a safety feature that prevents the first and second locks controlled by the respective first and second cylinders C1,C2 from being unlocked simultaneously. The switches SW1,SW2 can be simple toggle-type switches or can be a more advanced switching system including a microprocessor or the like that allows for sophisticated control of switch activation and associated features as described above in relation to switch SW2 of FIG. 1A.

The switch SW1 is normally in the "lock" position so that when the switch SW2 is closed by an operator to initiate decoupling operations, current flows through an indicator lamp or LED or the like L2 located in the operator's cab so that the operator receives a visual indication that the switch SW2 is closed. Closing of the switch SW2 also results in current flow through an audible buzzer/beeper B2 located inside the operator'scab so that the operator receives an audible indication that the switch SW2 is closed.

If the pressure switches PS4,PS1 are closed (i.e., if conditions (i) and (ii) above are met) closing of switch SW2 results in current flow through the coil of solenoid valve SV3 to energize the solenoid valve SV3 and actuate or shift same. This results in retraction of piston P2 and rod R2 of cylinder C2 owing to the establishment of cross-flow in the paths LE,LR as described above. Current flow through coil of valve SV3 acts as a switching current to relay RE3 and causes same to switch from a first, normal conductive state as shown, where a current path between terminals 5-1 is provided, to a second conductive state where a current path between terminals 5-3 is provided. In the second conductive state, relay RE3 provides a bypass around pressure switches PS1,PS4 for current flow through coil of valve SV3 to ground. As such, when relay RE3 is in its second conductive state, pressure switches PS1,PS4 are effectively removed from the circuit 210' and do not affect current flow even if one or both subsequently open as required for coupling/decoupling operations. Valve SV3 will be actuated to maintain rod and piston R2,P2 of cylinder C2 in a retracted condition until an operator opens switch SW2 or moves switch SW1 to "unlock." This ensures that a lock controlled by cylinder C2 will remain unlocked for a sufficient time as needed to complete coupling/decoupling operations.

After an operator has completed a decoupling operation with respect to a lock controlled by the cylinder C2 by closing switch SW2 as just described, the operator will desire to complete a second decoupling operation with respect to a lock controlled by the cylinder C1. As such, the operator will actuate switch SW1 to switch same to the "unlock" position. This results in the circuit to switch SW2 and coil of solenoid SW3 being opened. Current through coil of valve SV3 is interrupted and relay RE3 resets to its first conductive state. At the same time, current flows to a visual indicator L1 such as a lamp or LED or the like to indicate that the switch SW1 has been moved to the "unlock" position. When the switch SW1 is set to "unlock" current flows via bridge BR1 to inside beeper B2 to provide an audible signal to an operator in the machine cab. Also, with switch SW1 set to "unlock" current flows to the timer TD1 and through relay RE1 to a beeper/buzzer B1 located outside the operator's cab to warn workers and others that an attachment de-coupling operation is being carried out.

After a select delay (e.g., 5 sec.) the timer TD1 latches so that a switching current also flows to relay RE1 and causes relay to switch from a first conductive state (as shown with terminals 5-1 connected) to a second conductive state (in which terminals 5-3 are connected). In the second conductive state of relay RE1, the outside beeper B1 is de-energized. If, at the same time, the first and second hydraulic pressure switches PS4,PS1 are closed (i.e., conditions (i) and (ii) above are satisfied), the circuit between the voltage source V+ and ground is complete and the coil of solenoid valve SV2 is energized to actuate or shift the solenoid valve SV2 as described above in relation to FIG. 1A to retract the piston P1 and rod R1 of cylinder C1. Here, again, current flow through coil of SV2 switches relay RE2 from its first, normal conductive state as shown in FIG. 2B to a second state where terminals 5-3 are connected. In its second conductive state, relay RE2 provides a direct ground path for the current flowing through coil of SV2 so that pressure switches PS1,PS4 are bypassed until relay RE2 is reset when switch SW1 is moved to the "lock" position to interrupt current flow through the coil of SV2. As such, the relay RE2 ensures that opening of either switch PS1,PS4 will not interfere with coupling or decoupling operations once these operations are initiated.

The diode bridge BR1 is provided as a circuit protection device to prevent damage to the lamps L1,L2 and other circuit components, and also prevents current flow from switch SW2 to components located upstream from the bridge BR1.

In a typical de-coupling operation, an operator will move the associated attachment to the required de-coupling position such as full-curl or full-extend using a joystick or other control device. This, results in an "over-relief" pressure sufficient to close pressure switch PS4. If the operator maintains the joystick J or other control device in the fully displaced or other select position that resulted in movement of the attachment to the de-coupling position, the pressure in pilot path PP will close switch PS1. The operator then activates switch SW2 to energize the coil of solenoid valve SV3 and retract piston P2 and rod R2 to allow the second attachment locking mechanism to be opened so that a control link can be de-coupled and moved away from the attachment so as not to be inadvertently re-coupled. The operator then moves switch SW1 to the "unlock" position so that the coil of solenoid SV2 is energized to retract piston P1 and rod R1 of cylinder C1 to open a first lock associated therewith after the above-described delay/warning sequence is carried out. Once the lock controlled by the first cylinder C1 is opened, the arm or dipper stick of the machine is moved away from the attachment. It is noted that upon switch SW1 being moved to the "unlock" position, the lock associated with the cylinder C2 and machine control link will automatically re-engage, but the machine control link will have already been moved out of a coupling position by the operator so that re-coupling of the attachment to the control link will not occur.

Coupling operations are performed in the opposite sequence as will be readily apparent to those of ordinary skill in the art. In general, the cylinder C1 is first retracted via operation of switch SW1 to allow for coupling an attachment to the arm or dipper stick. The switch SW1 is then moved to "lock" so that the piston and rod P1,R1 of cylinder C1 are extended to capture the attachment to the arm or stick by way of an associated lock controlled by the cylinder C1. The switch SW2 is then actuated to retract piston and rod P2,R2 of cylinder C2 to allow the attachment to be coupled to a control link. Once the attachment is located as desired, the switch SW2 is opened so that the piston and rod P2,R2 extend to capture the attachment to the link by way of an associated locking mechanism controlled by cylinder C2.

Figure 2C:
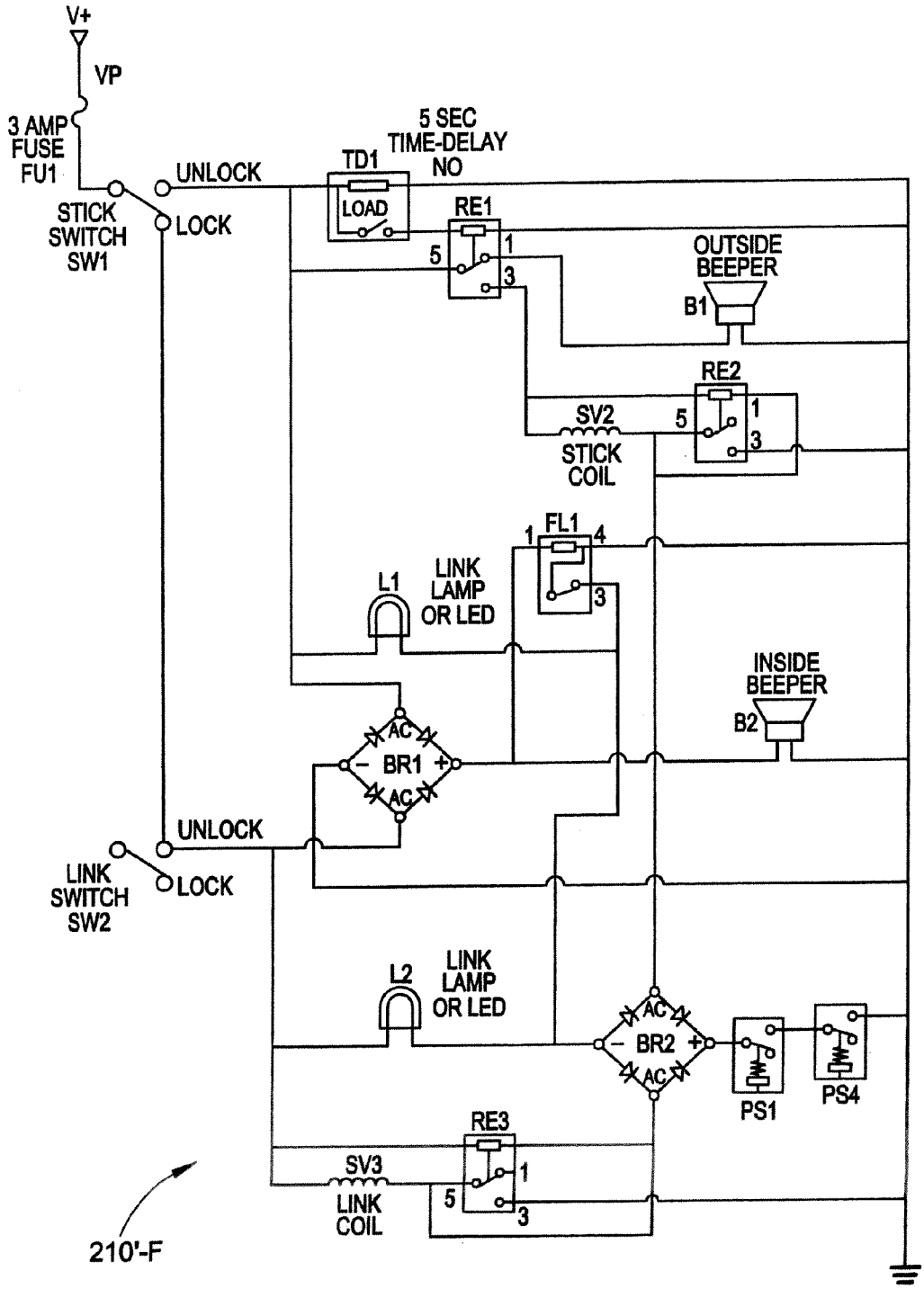
FIG. 2C is a schematic diagram of an alternative electrical circuit for controlling a two-actuator hydraulic circuit in accordance with the present invention.

With brief reference to FIG. 2C, a circuit 210'-F is illustrated. Except as shown and/or described, circuit 210'-F is structured and functions identically to circuit 210'. Unlike circuit 210', however, circuit 210'-F comprises a flasher FL1 that causes visual indicators L1,L2 to flash for a select period of time that can be varied when energized to ensure that an operator notices same. In one embodiment, the flasher is set to flash the visual indicators L1,L2 while actuators C1,C2 are performing unlocking (de-coupling) operations, and to maintain the visual indicators in a lighted condition thereafter when unlocking operations are completed, i.e., the timer within the flasher corresponds to the length of time for the actuators C1,C2 to cycle.

Figure 3A:
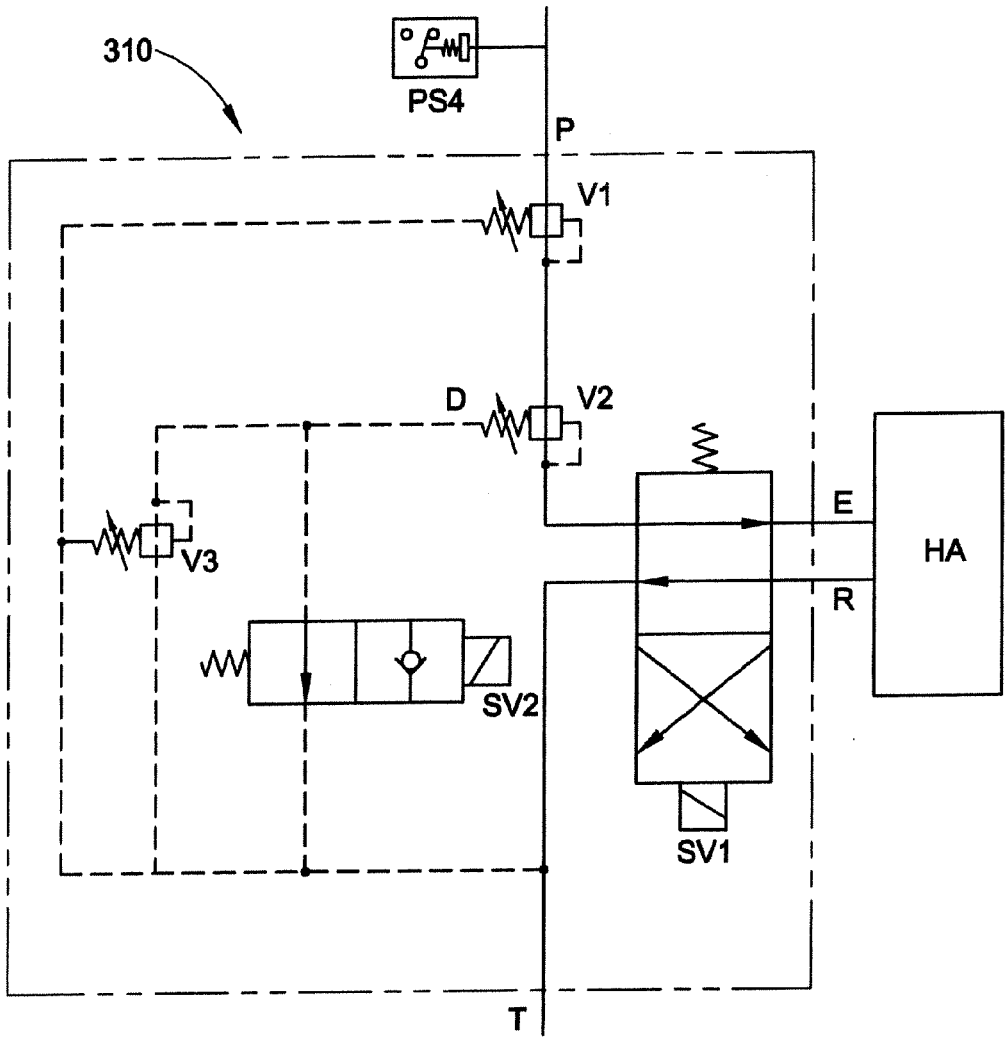
FIG. 3A is a schematic diagram of an alternative hydraulic circuit for controlling a single hydraulic actuator in accordance with the present invention.

FIG. 3A illustrates a hydraulic circuit 310 suitable for controlling a hydraulic actuator HA that can be, e.g., a hydraulic cylinder or a motor drivingly connected to a jackscrew assembly. The actuator HA can be used to control a lock of a quick coupler or can be used to expand the quick coupler from a first state for coupling/decoupling to a second state for fixedly securing an attachment to the arm/stick of an excavator or other machine. Circuit 310 comprises a hydraulic fluid input path P that receives flow from a pump and a hydraulic fluid return or output path T that flows to a reservoir. First and second pressure reducing valves V1,V2 serially reduce pressure in path P and are in communication with solenoid valve SV1. In its normal, deenergized state, solenoid valve SV1 provides simple flow-through for the path P to an "extend" path E that flows to the actuator HA to operate same in a first direction to actuate a locking or coupling mechanism controlled thereby. "Retract" path R from actuator HA flows through solenoid valve SV1 to the reservoir via path T. As shown, when coil of valve SV1 is energized, the valve SV1 is actuated so that the spool thereof is shifted to provide cross-flow so that input path P is communicated to "retract" path R and so that "extend" path E is communicated to the reservoir via path T. This, then reverses operation of the actuator HA to de-actuate the locking or coupling mechanism controlled thereby (a pilot check valve such as PCV1 is also preferably provided as described above but is not shown again here). It is possible, however, for the actuator HA to become stuck so that it resists de-actuation when valve SV1 is energized. Accordingly, circuit 310 includes a pressure boost feature to overcome this potential problem.

More particularly, a solenoid valve SV2 is provided in communication with a drain line D of pressure reducing valve V2. Valve SV2 normally allows relatively unrestricted flow of drain line D to the reservoir via path T. When valve SV2 is energized, it acts as a check valve to block flow of drain line D therethrough. As such, when valve SV2 is energized, drain line D can flow to path T and reservoir only through a pressure relief valve V3 when pressure in drain path D exceeds a select threshold. Therefore, when valve SV2 is energized, flow through drain line D is significantly restricted and, thus, the pressure drop across valve V2 is lessened or eliminated so that pressure in path P downstream from valve V2 (at valve SV1) is boosted.

Figure 3B:
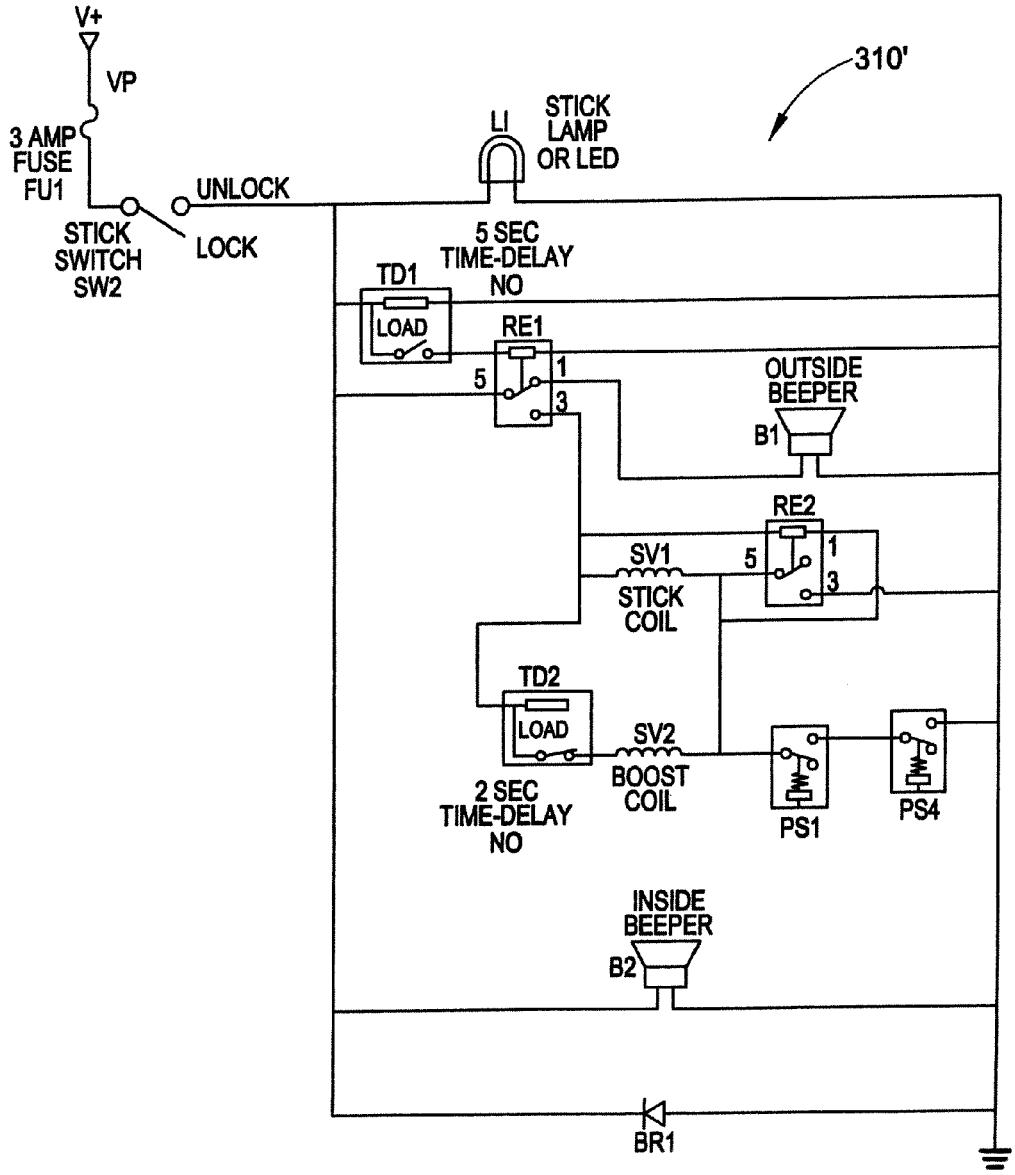
FIG. 3B is a schematic diagram of an electrical circuit for controlling the single-actuator hydraulic circuit shown in FIG. 3A in accordance with the present invention.

FIG. 3B illustrates an electrical circuit 310' for controlling the circuit 310 and, in particular, valve SV1 and SV2 thereof. A DC operating voltage V+ is supplied to a switch SW2 located in the operator cab via voltage input path VP. The switch SW2 is a simple toggle switch or can be a more advanced switching system as described above in relation to FIG. 1B. When the switch SW2 is opened, the coils of the valves SV1,SV2 are de-energized owing to the open circuit relative to voltage source V+. When the switch SW2 is closed, current flows through an indicator lamp or LED or the like L1 located in the operator's cab so that the operator receives a visual indication that the switch SW2 is closed. Closing of the switch SW2 also results in current flow through an audible buzzer/beeper B2 located inside the operator'scab so that the operator receives an audible indication that the switch SW2 is closed.

When the switch SW2 is closed, current flows to a timer TD1 and through relay RE1 to a beeper/buzzer B1 located outside the operator's cab to warn workers and others that the switch SW2 is closed (i.e., that a de-coupling operation is being carried out).

After a select delay (e.g., 5 sec.) according to the parameters of timer TD1, the timer TD1 latches so that a switching current also flows to relay RE1 and causes relay to switch from a first conductive state (as shown with terminals 5-1 connected) to a second conductive state (in which terminals 5-3 are connected). In the second conductive state of relay RE1, the outside beeper B1 is de-energized. If, at the same time, the first and second hydraulic pressure switches PS4, PS1 are closed (i.e., conditions (i) and (ii) above are satisfied), the circuit between the voltage source V+ and ground is complete and the coil of solenoid valve SV1 is energized to actuate or shift the solenoid valve SV1 as described above in relation to FIG. 1A so that cross-flow is established in paths R,E causing reversal of actuator HA. At the same time, current flow through coil of solenoid valve SV2 provides a switching current to relay RE2 that causes relay RE2 to switch from a first (normal) conductive state, with terminals 5-1 connected, to a second conductive state, with terminals 5-3 connected. When the relay RE2 is in its second conductive state, the pressure switches PS4,PS1 are bypassed so that if either or both of these switches opens, the coil of valve SV2 remains energized via current flow through relay RE2 to ground for reasons as described above to allow an operator to maneuver the coupling device in an effort to couple to or decouple from an attachment without deenergization of valve SV1.

When coil of valve SV1 is energized, current also flows to coil of valve SV2 to energize same via second timer TD2. As such, valve SV2 is energized to provide the above-described hydraulic pressure boost in path P downstream from pressure reducing valve V2. After a select delay according to timer TD2, e.g., 2 seconds, timer TD2 opens the circuit upstream from coil of valve SV2 so that valve SV2 is deenergized and so that the pressure boost in circuit 310 is eliminated.

When the operator opens switch SW2, current flow through coil of valve SV1 ceases so that the valve SV1 returns to its normal state and so that relay RE2 resets.

Figure 3C:
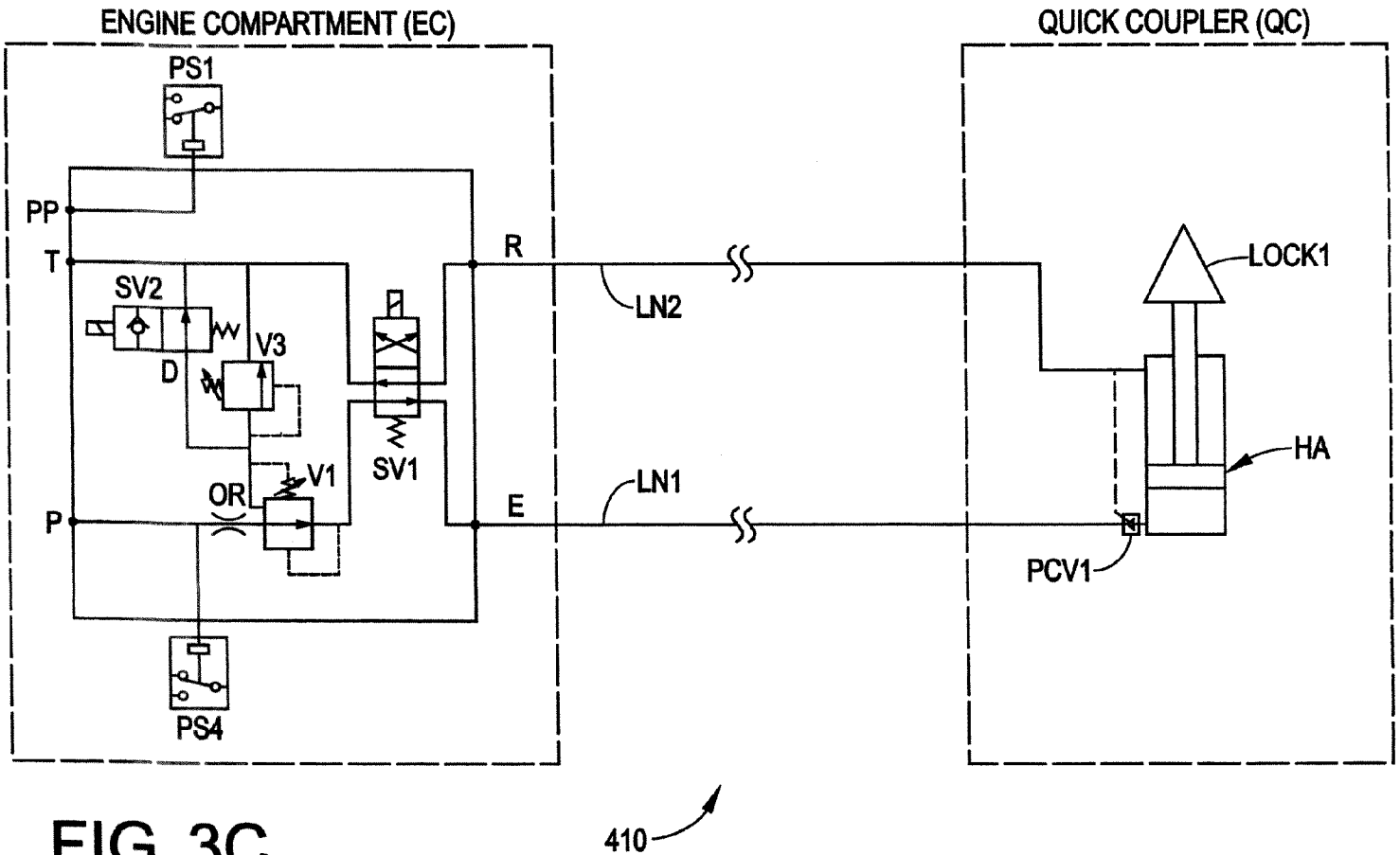
FIG. 3C illustrates an alternative hydraulic circuit including a boost feature.

FIG. 3C illustrates an alternative hydraulic circuit 410 including a boost feature similar to that described above with reference to the hydraulic circuit 310. The circuit 410 is used to control a hydraulic actuator HA that can be, e.g., a hydraulic cylinder or a motor drivingly connected to a jackscrew assembly. The actuator HA can be used to control a lock LOCK1 of a quick coupler QC or can be used to expand the quick coupler QC from a first state for coupling/decoupling to a second state for fixedly securing an attachment to the arm/stick of an excavator or other machine. Circuit 410 comprises a hydraulic fluid input path P that receives flow from a pump and a hydraulic fluid return or output path T that flows to a reservoir. An orifice OR reduces the fluid flow rate from a first rate (e.g., 10 gpm) to a second rate (e.g., 3 gpm). A pressure reducing valve V1 reduces pressure in path P upstream from solenoid valve SV1. In its normal, deenergized state, solenoid valve SV1 provides simple flow-through for the path P to an "extend" path E that flows to the actuator HA to operate same in a first direction. "Retract" path R from actuator HA flows through solenoid valve SV1 to the reservoir via path T. As shown, when coil of valve SV1 is energized, the valve SV1 is actuated so that the spool is shifted to provide cross-flow so that input path P is communicated to "retract" path R and so that "extend" path E is communicated to the reservoir via path T. This, then reverses operation of the actuator HA (a pilot check valve such as PCV1 is also preferably provided as described above but is not shown again here). The valve SV1 is operated as described above in relation to the circuit 310 insofar as the pressure switches PS1,PS4 are concerned.

Figure 4:
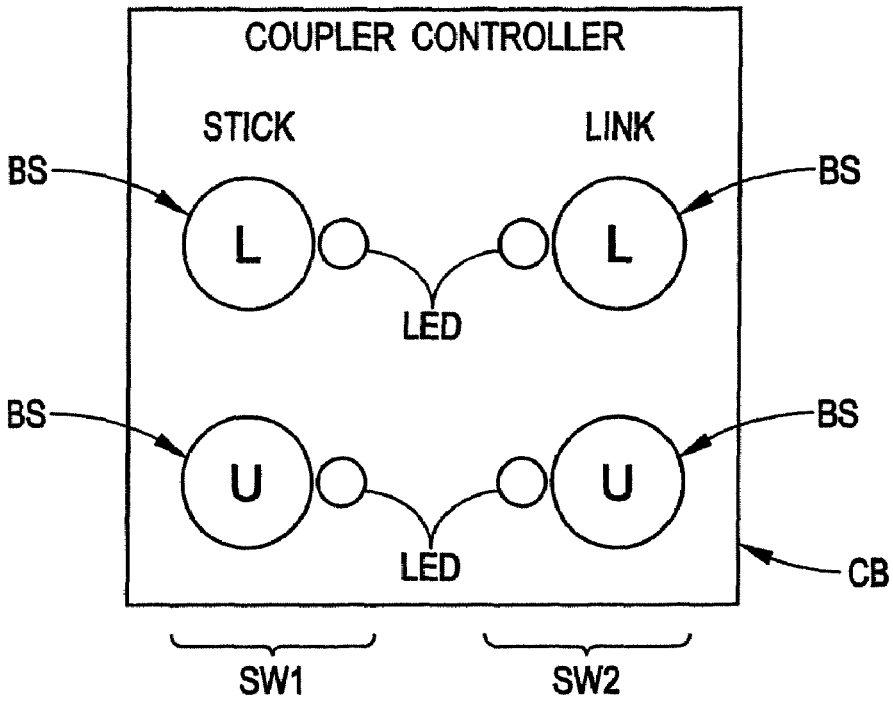
FIG. 4 diagrammatically illustrates an example of a control box for housing the electrical circuits of FIGS. 1C, 2B, 2C, 2D or 3B in accordance with the present invention.

As noted above, the actuator HA can sometimes become stuck so that it resists reverse movement when valve SV1 is energized. Accordingly, circuit 410 includes a pressure boost feature to overcome this potential problem. More particularly, a poppet valve SV2 is provided in communication with a drain line D of pressure reducing valve V1. Poppet valve SV2 normally allows flow of drain line D to the reservoir via path T. When poppet valve SV2 is actuated/energized, the spool thereof is shifted to a position where the poppet valve acts as a check valve to block flow of drain line D therethrough. As such, when poppet valve SV2 is energized, drain line D can flow to path T and reservoir only through a sequence valve V3 when pressure in drain path D exceeds a select threshold. Therefore, when poppet valve SV2 is energized, flow through drain line D is significantly restricted and, thus, the pressure drop across valve V1 is lessened or eliminated so that pressure in path P downstream from valve V1 (at valve SV1) is boosted. FIG. 4 illustrates an example of a control box CB for housing any of the electrical circuits described above. In the illustrated example, the switches SW1,SW2 are provided by "bubble" switches BS that must be depressed and maintained in the depressed state for at least one second to be actuated. LED's provide a visual indication as to when a bubble switch BS has been depressed properly for actuation. Of course, for the circuits 10' and 310', the control box CB would include only the switch SW2 and not the switch SW1 and would be labeled accordingly.

The audible buzzers/beepers B1,B2 can be provided by any suitable audible speaker device. In one preferred embodiment, the output of buzzers/beepers B1,B2 increases in volume as ambient noise increases and decreases as ambient noise decreases. Suitable buzzers/beepers are available from ECCO (www.eccolink.com) under various trademarks including SMART ALARM®.

While the preferred embodiments disclosed herein have been described primarily with reference to hydraulic cylinders, those of ordinary skill in the art will recognize that any other hydraulic actuator such as a motor, jackscrew or the like can be substituted for either or both of the cylinders C1,C2 without departing from the overall scope and intent of the present invention. It is not intended that the invention be limited for use with hydraulic cylinders or any other particular type of hydraulic actuator.

Of course, the electrical circuits and/or any portion of same described herein can also be implemented by solid-state devices and using micro controllers, software and/or other means to accomplish the functions described above. It is not intended that the invention be limited to the particular components shown herein. For example, the pressure sensing switches PS1,PS4 can each comprises a pressure sensor electrically connected to an electronic control circuit that output various control signals in response to the sensed pressure to control the flow of current through the coils of the various solenoid valves SV2,SV3 described above. The terms "switch" and "relay" are intended to encompass both mechanical switches and relays as well as electronic devices for selective conductivity of electrical current based upon manual input, in the case of switches, and electrical input, in the case of relays. Devices such as transistors and silicone controlled rectifiers (SCR's) are examples of devices that can be used as switches and relays within the scope of the present invention.

Figure 5:
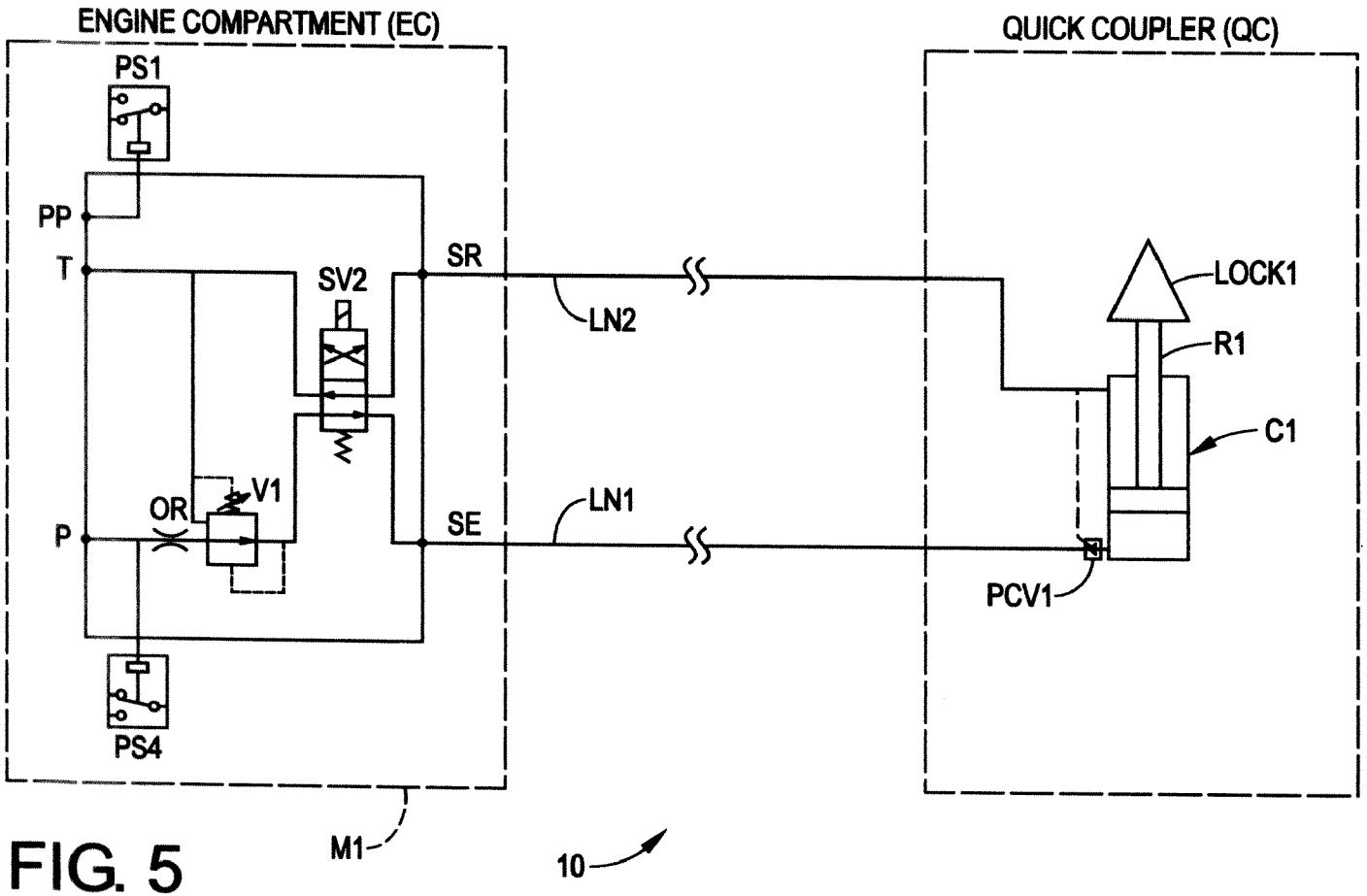
FIG. 5 shows an alternative implementation for the hydraulic circuit of FIG. 1A.

As shown in FIG. 5, the hydraulic circuit 10 can be implemented using a manifold M1 located in the engine compartment EC of the excavator/backhoe/machine or can be otherwise spaced from the attachment quick coupler QC including the actuator C1, wherein the flow paths SR,SE comprise hydraulic lines LN1,LN2. Because pressure is reduced in the manifold M1 by the valve V1, the pressure rating of the hydraulic lines LN1,LN2 can be reduced to reduce cost. As is also shown in FIG. 5, manifold M1 of the circuit 10 comprises an orifice OR to control the fluid flow rate to obtain to desired flow, e.g., 3 gallons per minute (gpm).

Figure 6:
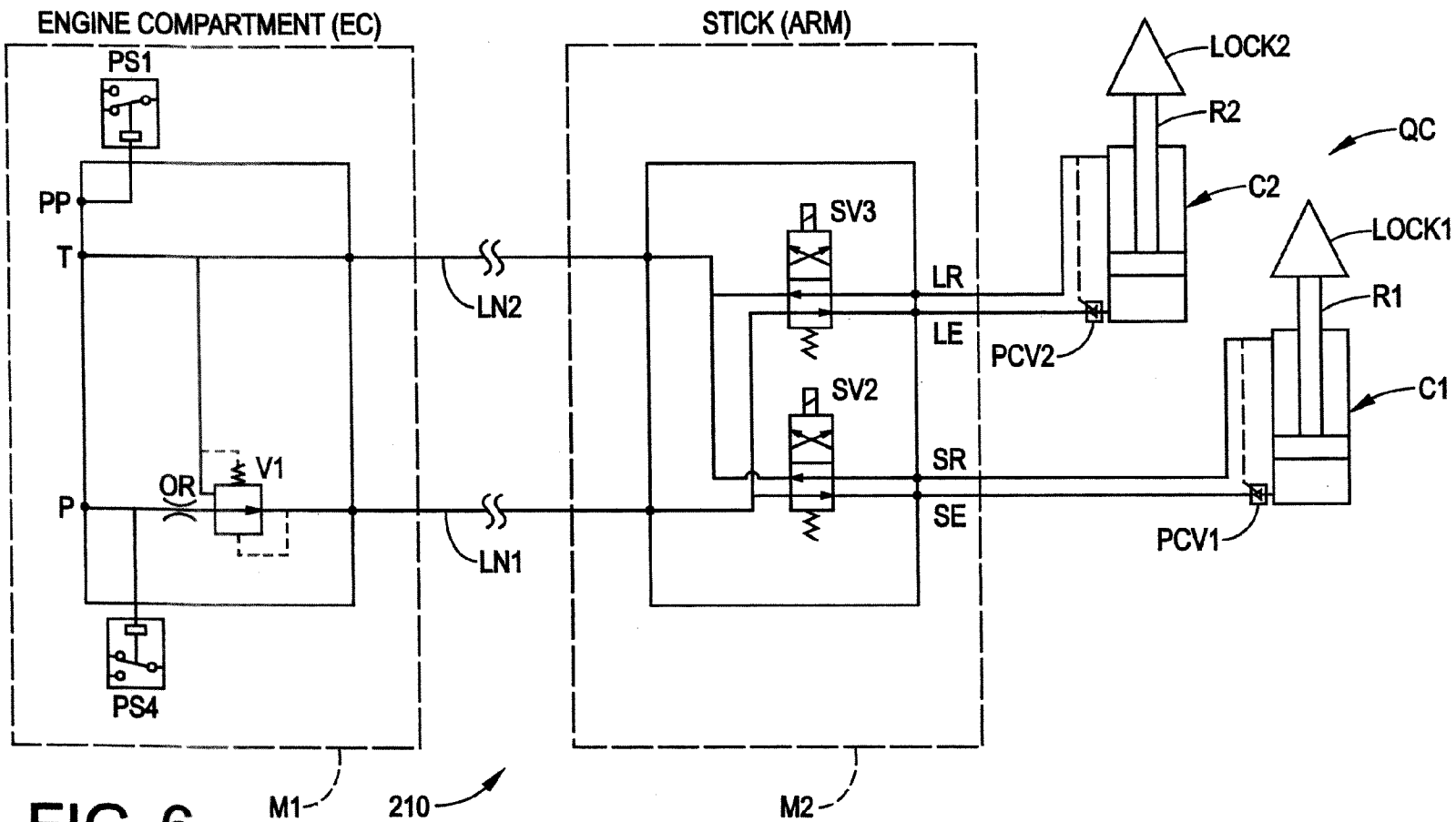
FIG. 6 shows an alternative implementation of the hydraulic circuit of FIG. 2A.

The hydraulic circuit 210 can be implemented in a similar fashion as shown in FIG. 6. There, it can be seen that the circuit 210 comprises first and second manifolds M1,M2 that are separate and spaced apart. In one embodiment, the first manifold M1 is located in the engine compartment EC and the second manifold is connected to the machine stick adjacent the attachment quick coupler QC, with the cylinders C1,C2 being part of the quick coupler QC. The manifold M1,M2 are fluidically interconnected by the hydraulic lines LN1,LN2, and, as noted above, these can have a reduced pressure rating because they are located on the lower pressure side of valve V1.

Figure 7A:
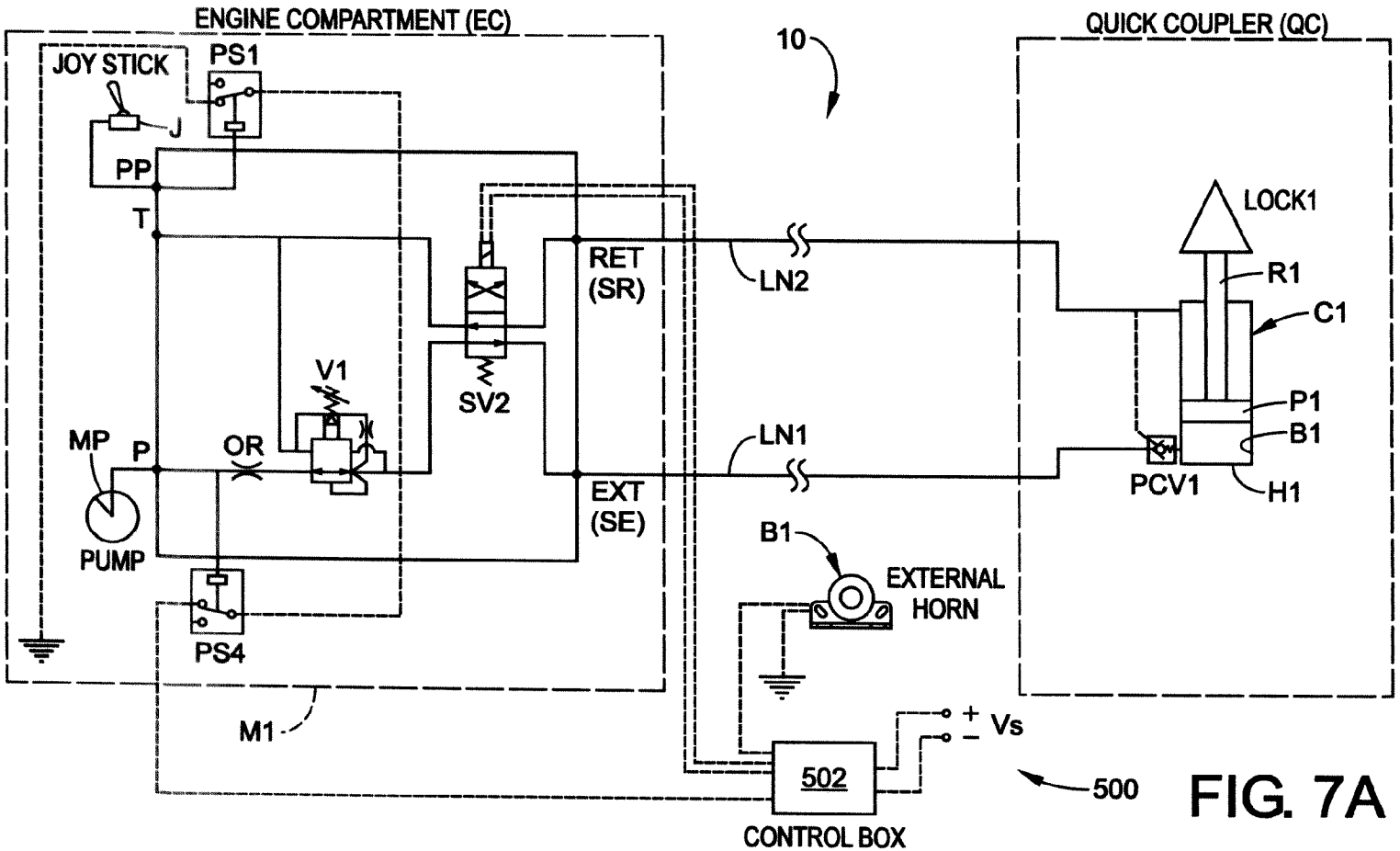
FIGS. 7A and 7B show the hydraulic circuits of FIGS. 5 and 6, respectively, and also show an alternative solid state electronic control system.
Figure 7B:
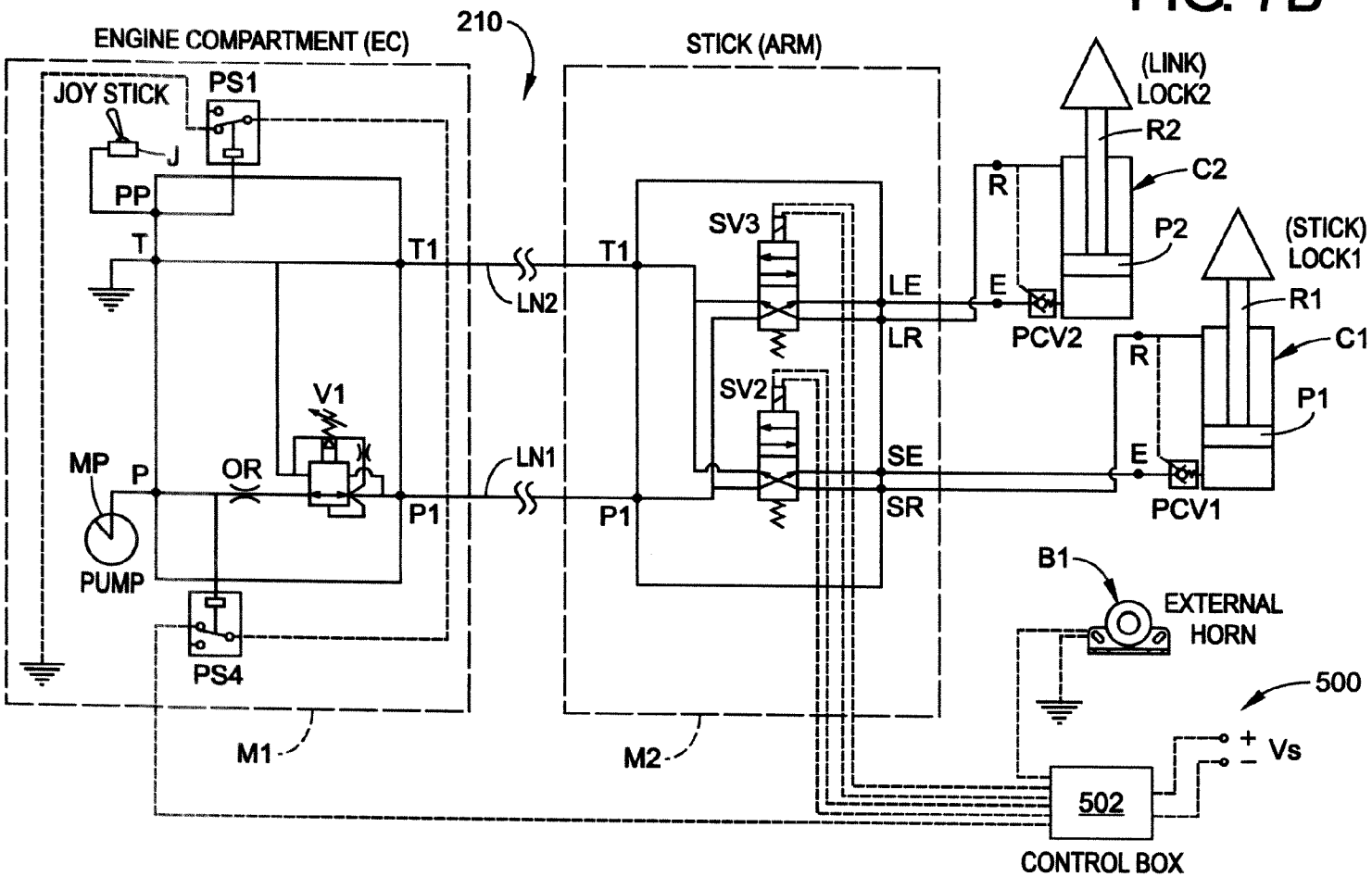

FIGS. 7A and 7B show the hydraulic circuits 10 and 210 of FIGS. 5 and 6, respectively. In addition, FIGS. 7A and 7B show a solid state electronic control system 500 that provides an alternative to the electrical control systems 10' and 210' described above for controlling the hydraulic circuits 10,210.

As shown, the electronic control system 500 comprises a control box 502 that is connected to a source of DC power Vs. As shown, the control box 502 is also operatively connected to the first and second pressure switches PS4,PS1, the first solenoid control valve SV2 (and also the second solenoid control valve SV3 for the circuit 210), and the external horn/buzzer/alarm B1 (the internal alarm B2 is typically provided within the control box 502 (see FIG. 7C).

Figure 7C:
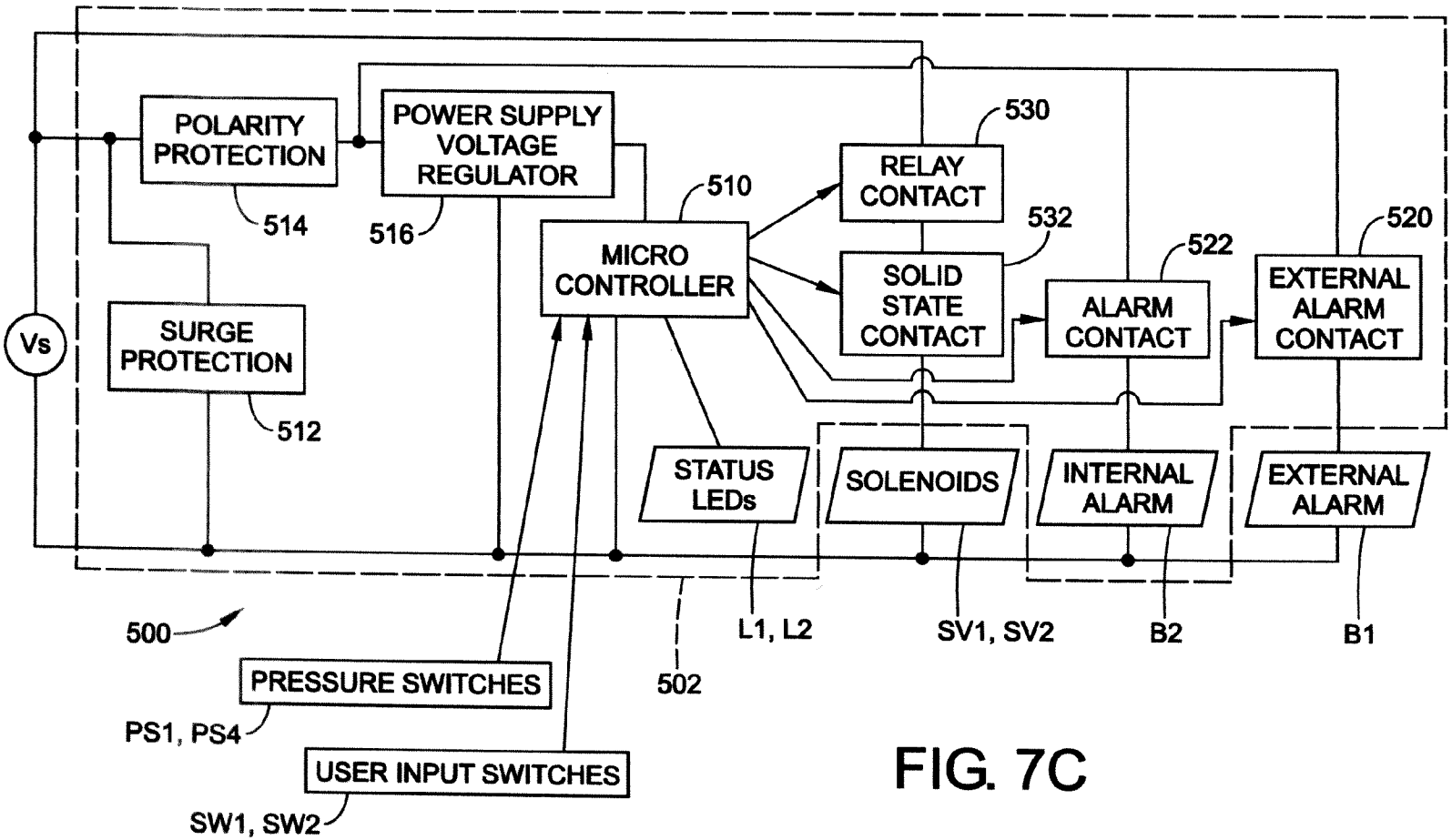
FIG. 7C diagrammatically shows the solid state electronic control system.

The electronic control system 500 comprising the control box 502 is shown in more detail in FIG. 7C. The control box 502 further comprises a microcontroller 510 powered by the DC source Vs, which is conditioned by a surge protector 512, polarity protector 514 and voltage regulator 516. As noted above, the pressure switches PS4,PS1 provide electrical input to the microcontroller, as does the user input switch SW2 (both of the switches SW1,SW2 when controlling the circuit 210). For the electronic control system 500, the user input switches are preferably electronic bubble switches BS as shown in FIG. 4, but mechanical switches or the like can be used.

Based upon the input received, the microcontroller 510 provides output electrical signals to drive the status LED or other light L1 (and also the status LED or other light L2 when controlling the circuit 210), the external horn/buzzer B1, the internal alarm B2 and the first solenoid control valve SV2 of the circuit 10 or both the first and second solenoid control valves SV2,SV3 of the circuit 210 (note that the solenoid valves SV2,SV3 are separately and individually controlled by the microcontroller 510).

The microcontroller 510 drives the status LED's L1,L2 to light these indicators as described above in relation to FIGS. 1C, 2B, 2C and 4, to indicate locked, unlocked, and/or unlocking status of the locks LOCK1,LOCK2. As noted in relation to FIG. 2C, the status LED's L1,L2 can optionally be driven by the microcontroller 510 to flash during locking/unlocking operations.

As noted, the microcontroller 510 provides the electrical output signals to drive the external and internal alarms B1,B2. In particular, the control box 502 comprises external and internal alarm switches or contacts 520,522 that are operatively connected to the microcontroller 510 and controlled by same. The contacts 520,522 are preferably solid state switches but alternatively can be mechanical contacts. To drive the alarms B1,B2, the microcontroller 510 operates the switches/contacts 520,522 to connect the buzzer/horn of the alarm B1,B2 to the voltage source Vs. In one embodiment, the microcontroller 510 is programmed to detect if the internal alarm B2 is inoperative due to a broken/cut wire in the circuit connecting the horn/buzzer B2 to the voltage source due to tampering or other cause. In particular, when the microcontroller activates the internal alarm B2 using the switch/contacts 522, the microcontroller also detects if current then flows through the circuit connecting the internal alarm B2 to the voltage source Vs. The absence of such current flow indicates an inoperative alarm B2. In one embodiment, as still another safety system, the microcontroller 510 is programmed to disable energization/actuation of either or both of the first and second solenoid control valves SV2,SV3 if the internal alarm B2 is deemed inoperative as just described.

The first solenoid control valve SV2 (and also the second solenoid control valve SV3 for the circuit 210) are selectively energized/actuated by the microcontroller 510 through mechanical relay contact(s) 530 and/or a solid state contact/switch(es) 532 (each solenoid control valve SV2, SV3 is controlled by the microcontroller 510 through a distinct contact 530 and/or switch 532 so as to be separately and individually controllable relative to the other solenoid control valve). As noted, the pressure switches PS4,PS1 and one or both of the user input switches SW1,SW2 provide input signals to the microcontroller 510. The microcontroller 510 is programmed to operate the first and second solenoid control valves SV2,SV3 in response to the state of the pressure switches PS4,PS1 and the user input switches SW1,SW2 in the same manner as described above with reference to the electrical circuit 10' of FIG. 1C (for the single lock hydraulic circuit 10 of FIG. 7A) and in the same manner as described above with reference to the electrical circuits 210' or 210'-F of FIGS. 2B, 2C (for the double lock circuit 210 of FIG. 7B). The microcontroller 510 is also programmed to require that each of the pressure switches PS4,PS1 be closed by the hydraulic pressure of the circuit 10,210 for a select continuous duration such as, e.g., 5 seconds, before the pressure switch PS4,PS1 is deemed to be closed by the microcontroller. As such, intermittent closing of either pressure switch, for a period of less than the select (e.g., 5 second) duration does not satisfy the above-noted requirement, and such closing of either pressure switch PS4,PS1 is deemed insufficient to allow the first and/or second solenoid control valve SV2,SV3 to be energized to effect retraction of the first or second locks LOCK1,LOCK2. Once the pressure switches PS4,PS1 are closed by hydraulic pressure for at least the select duration (such as the example 5 second duration) and the unlocking sequence is then initiated by operator movement of the user input switches SW1 and/or SW2 to the unlock state so as to actuate one or both of the solenoids SV1,SV2, the pressure switches are then deemed by the microcontroller 510 to be closed and subsequent opening of either pressure switch PS4,PS1 (which will occur as the operator executes an attachment coupling/decoupling operation) is ignored until after such time as the operator manipulates one or both of the user input switches SW1,SW2 to be in the locked position/state, which then causes the microcontroller reset with respect to the pressure switches PS4,PS1. Also, when the control system 500 is powered-off, it resets so that the pressure switches PS4,PS1 must again be closed for the select duration to initiate an unlocking operation.

In a similar manner, as also noted above, the microcontroller 510 is preferably also programmed to require that the user input switches SW1,SW2 be closed for a select continuous duration (e.g., 1 second) before the switch is deemed closed by the microcontroller in order for the solenoid control valve SV2 (and also SV3 for the circuit 210) to be energized/actuated for unlocking of the lock LOCK1 (and also the lock LOCK2 for the circuit 210). For both hydraulic circuits 10,210, the microcontroller 510 is also programmed to provide a 5 second or other select delay before energizing/actuating the solenoid control valve SV2 which controls the only or main (stick) lock LOCK1, during which delay period the microcontroller activates the external and internal alarms B1,B2 and the status light L1 to warn an operator and those nearby that an attachment decoupling operation is about to occur (for the dual lock circuit 210, when the secondary (link) lock LOCK2 is being unlocked by an operator using the switch SW2, only the internal alarm B2 and internal status light L2 are activated and there is no delay before the solenoid SV3 is energized/actuated). In terms of hydraulic fluid flow, the hydraulic circuits 10,210 function otherwise exactly as described above in connection with FIGS. 5 and 6 and elsewhere above. As described above in connection with the electrical circuit 210', for the dual lock hydraulic circuit 210, the control system 500 is programmed such that the locks LOCK1 and LOCK2 cannot be simultaneously unlocked, i.e., when the user input switch SW2 is set to the unlock position for the link lock LOCK2, the solenoid SV2 will be deenergized/deactuated if not already in such state so that the stick lock LOCK1 will be in or move into the locked position when the link lock LOCK2 opens, or if the switch SW1 is set to the unlock position to unlock the main (stick) lock LOCK1, the solenoid SV3 is automatically deenergized/deactuated so that the link lock LOCK2 will remain locked or will relock. Except as just noted, once a lock LOCK1,LOCK2 for either circuit 10,210 is unlocked, the control system 500 is programmed to keep the unlocked lock LOCK1,LOCK2 in the unlocked state, until the operator manipulates the related user input switch SW1,SW2 to be in the locked state once again, or until the system resets.

Figure 8A:
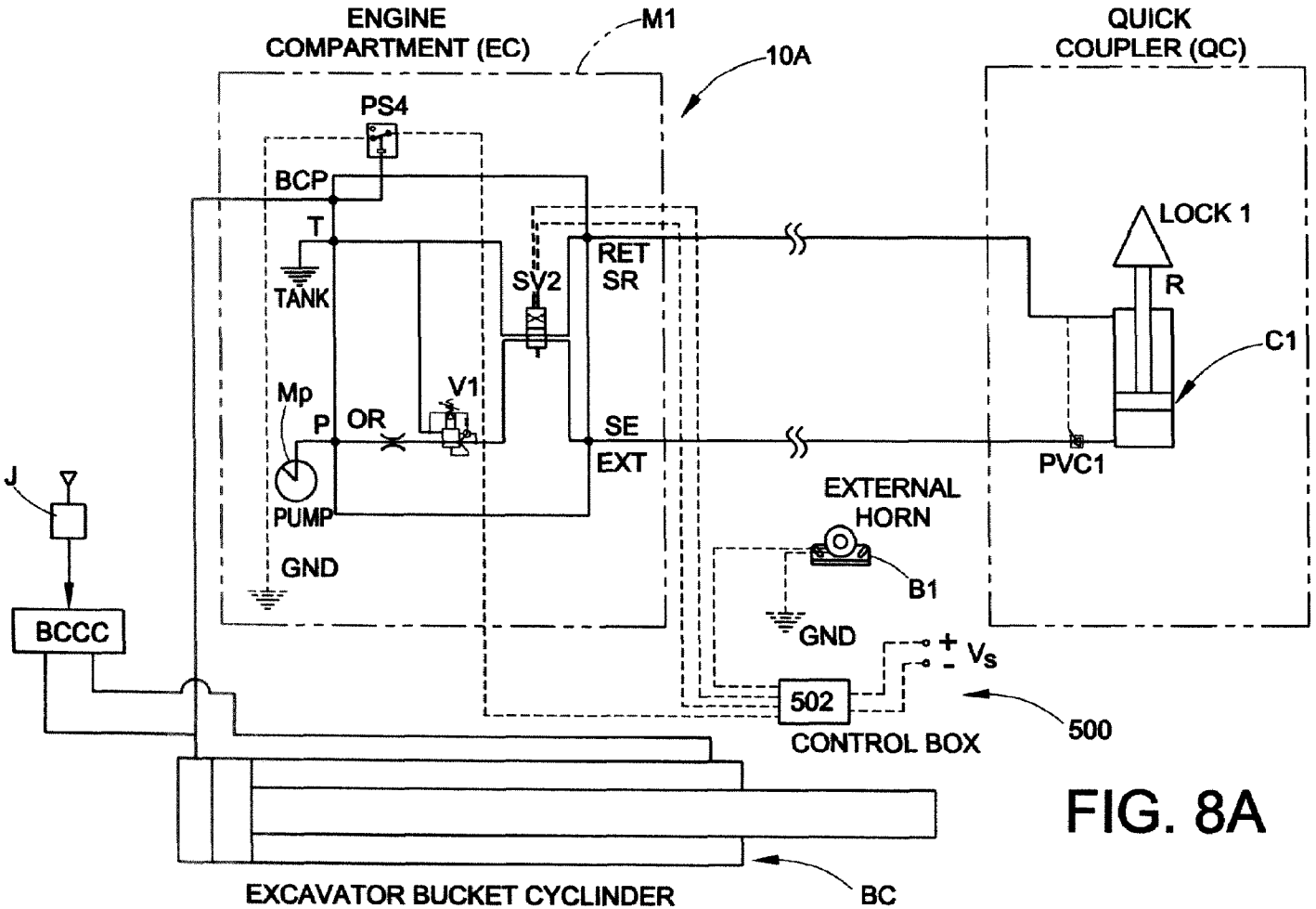
FIGS. 8A and 8B show alternative single pressure sensor hydraulic circuits controlled by the solid state electronic control system.
Figure 8B:
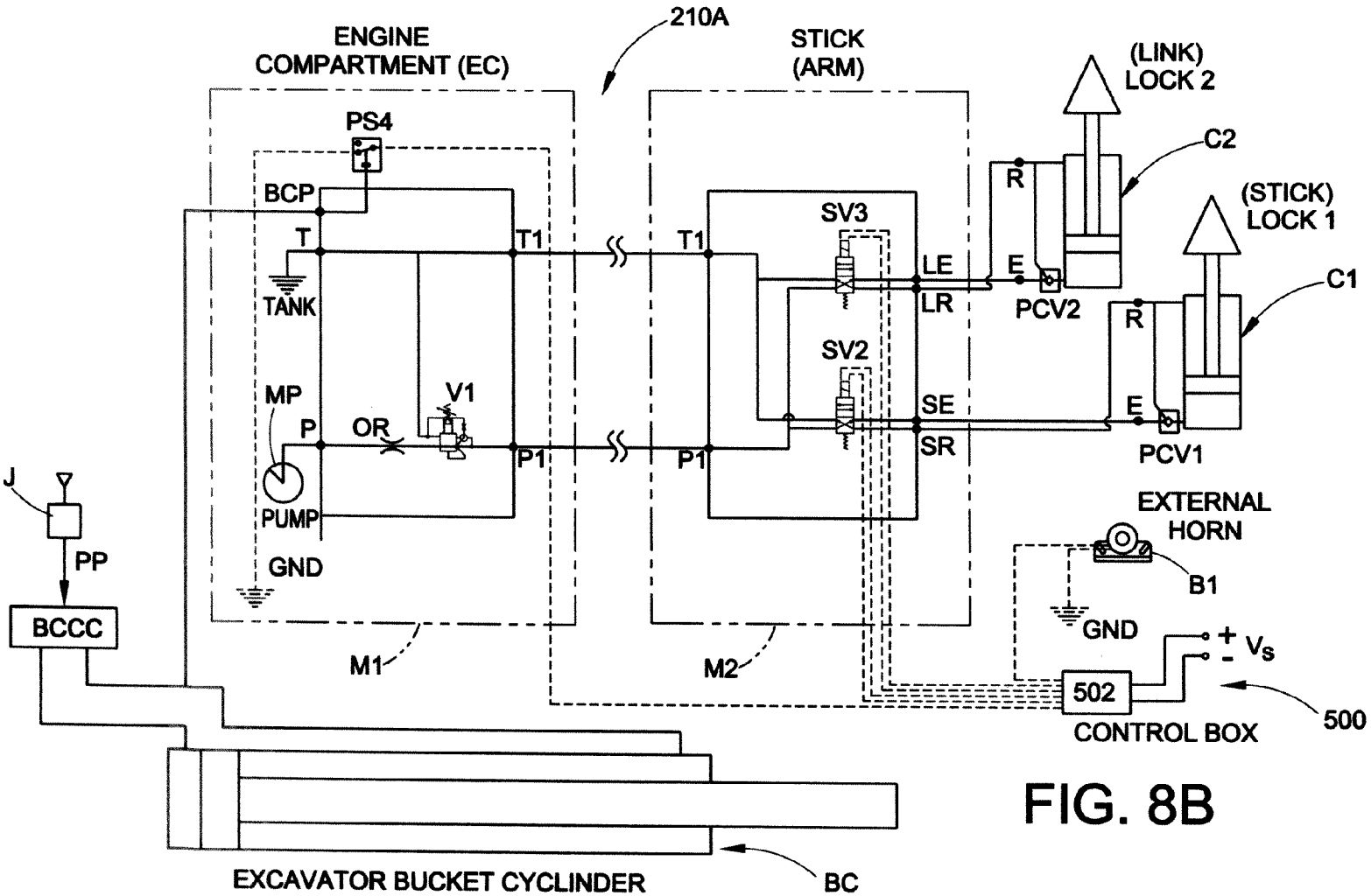

FIGS. 8A and 8B show hydraulic circuits 10A and 210A that are respectively identical to the hydraulic circuits 10 and 210 described above, except for differences that are shown and described here, and also show the solid state electronic control system 500 operatively connected to the circuits 10A,210A for controlling same as just described. The circuits 10A and 210A are identical to the circuits 10 and 210, except that only a single pressure switch PS4 is provided to sense hydraulic pressure and provide input to the electronic control system 500. In particular, for the hydraulic circuit 10A of FIG. 8A, the pressure switch PS4 is connected to sense the hydraulic pressure behind (on the extend side on the piston of the excavator bucket cylinder BC as provided by the bucket cylinder control circuit BCCC (see also FIG. 1B) at port BCP, while for the dual lock hydraulic circuit 210A of FIG. 8B, the single pressure switch PS4 is connected to sense the hydraulic pressure ahead of (on the retract side on the piston of the excavator bucket cylinder BC as provided by the bucket cylinder control circuit BCCC at port BCP. The pressure switch PS1 is not required for either circuit 10A,210A. Instead, for the circuit 10A of FIG. 8A, the pressure switch PS4 is set to close at a select pressure (e.g., 4700 psi) that occurs when the bucket cylinder BC is fully extended and being actively pressurized to the fully extended position by the position of the operator joystick J or other controls, typically corresponding to a fully curled position of the attachment quick coupler QC. For the circuit 210A of FIG. 8B, the pressure switch PS4 is set to close at a select pressure (e.g., 4700 psi) that occurs when the bucket cylinder BC is fully retracted and being actively pressurized to the fully retracted position by the position of the operator joystick J or other controls, typically corresponding to a fully extended (rolled-back) position of the attachment quick coupler QC, which provides a safe attachment decoupling position for a dual lock system. In either case, when the pressure switch PS4 closes for the required select continuous (uninterrupted) duration as described above (e.g., 5 seconds), this is sensed by the microcontroller 510 as a safe condition to begin the above-described unlocking sequence for the lock LOCK1 using the first solenoid control valve SV2 (and also for unlocking the lock LOCK2 using the second solenoid control valve SV3 for the circuit 210A), with operation of the external and/or internal alarms B1,B2 as described above. As in the case of the hydraulic circuits 10,210, in the circuits 10A and 210A, the spring-biased default (non-actuated) position for the first and second solenoid control valves SV2,SV3 provides fluid pressure from the pump MP to the extend side ports SE and LE for the respective locks LOCK1 and LOCK2, to ensure that these locks are pressurized to their locked positions in the absence of actuation of the solenoid control valves SV2,SV3. Alternatively, the control circuits 10',210',210'-F can be used to control the hydraulic circuits 10A,210A, of course using only the single pressure sensor PS4 as part of the circuits 10',210',210'F.

Figure 9A:
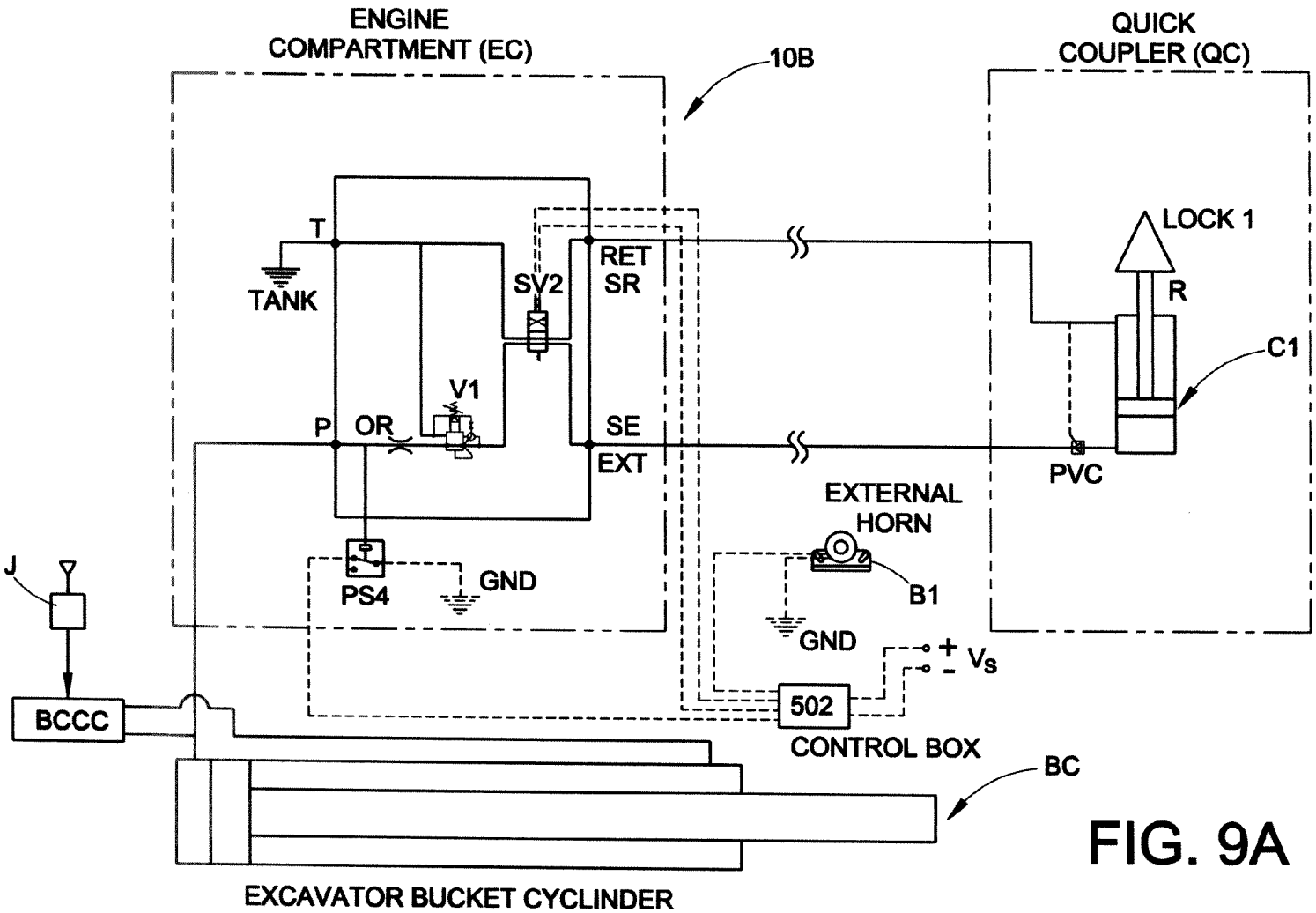
FIGS. 9A and 9B show alternative single pressure sensor hydraulic circuits controlled by the solid state electronic control system.
Figure 9B:
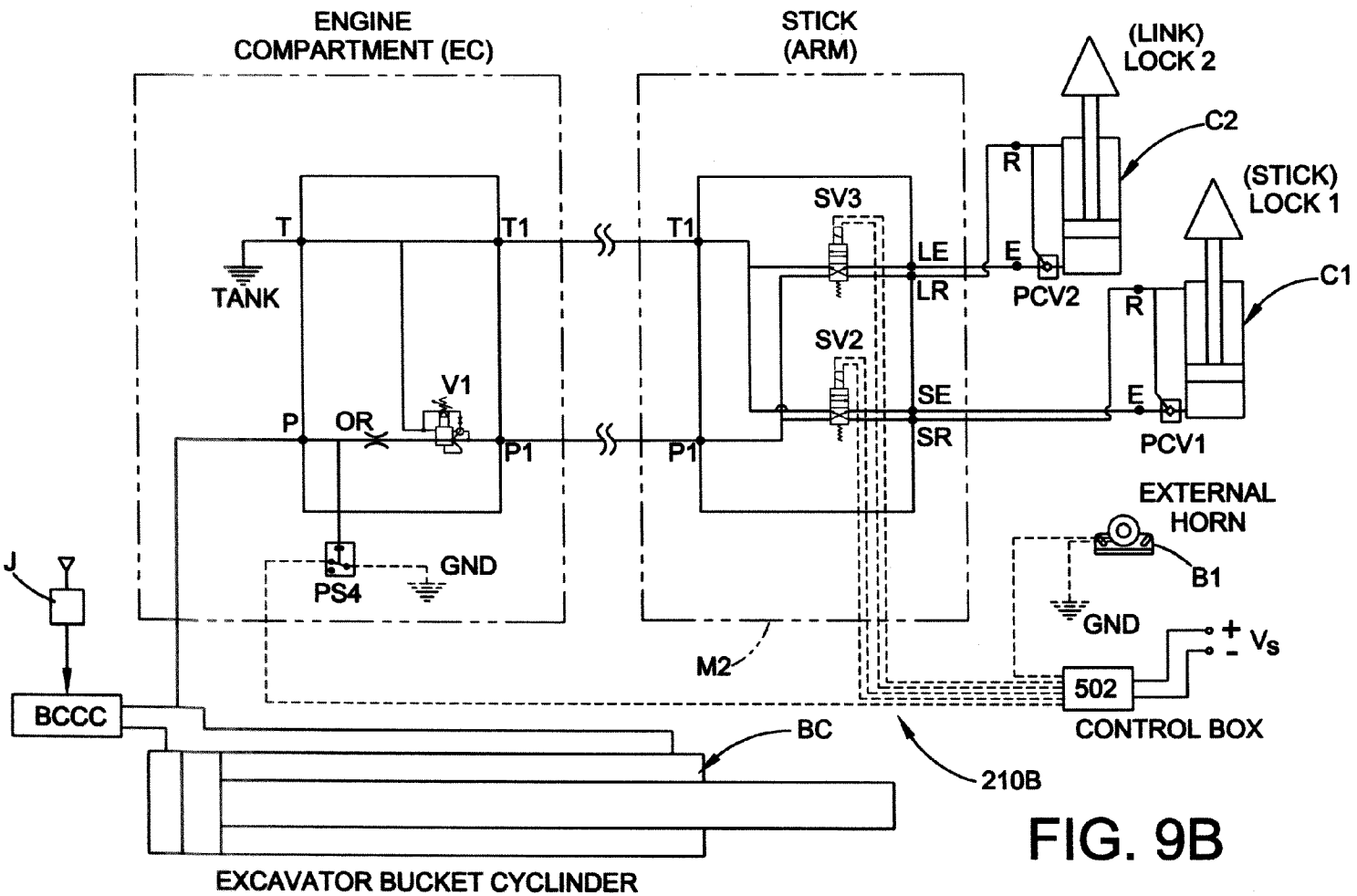

FIGS. 9A and 9B show hydraulic circuits 10B and 210B that are respectively similar to the hydraulic circuits 10A and 210A described above, except for differences that are shown and described here. Again, the solid state electronic control system 500 is operatively connected to the circuits 10B, 210B for controlling same. The circuits 10B and 210B are similar to the circuits 10A and 210A in that only the single pressure switch PS4 is provided to sense hydraulic pressure and provide input to the electronic control system 500. In particular, for the single lock circuit 10B, the pressure switch PS4 is connected to sense the hydraulic pressure behind (on the extend side on the piston of the excavator bucket cylinder BC as provided by the bucket cylinder control circuit BCCC. The pressure switch PS1 is not required. The pressure switch PS4 is set to close at a select pressure (e.g., 4700 psi) that occurs when the bucket cylinder is fully extended and being actively pressurized to the fully extended position by the position of the operator joystick J or other controls. For the dual lock circuit 210B, the pressure switch PS4 is set to close at a select pressure (e.g., 4700 psi) that occurs when the bucket cylinder BC is fully retracted and being actively pressurized to the fully retracted position by the position of the operator joystick J or other controls (typically corresponding to a fully extended or rolled-back position of the attachment quick coupler QC) which provides a safe attachment decoupling position for a dual lock system. When the pressure switch PS4 closes for the required select continuous (uninterrupted) duration as described above (e.g., 5 seconds), this is sensed by the control system 500 as a safe condition to begin the above-described unlocking sequence for the lock LOCK1 using the first solenoid control valve SV2 (and for also unlocking lock LOCK2 using the second solenoid control valve SV3 for the circuit 210B), with operation of the external and/or internal alarms B1,B2. Here, again, the spring-biased default (non-actuated) position for the first and second solenoid control valves SV2,SV3 provides fluid pressure from the bucket cylinder control circuit BCCC to the extend side ports SE and LE for the respective locks LOCK1 and LOCK2, to ensure that these locks are pressurized to their locked positions in the absence of actuation of the solenoid control valves SV2,SV3. The circuits 10B,210B are designed such that, in the event the valve SV2 or both valves SV2,SV3 are energized during a malfunction (i.e., when the switch PS4 is not closed), insufficient hydraulic fluid pressure would be present at the retract side of the lock LOCK1 (at port SR) or the retract side of both locks LOCK1,LOCK2 (ports SR,LR) to cause the locks to open, until such time as the bucket cylinder also becomes fully extended or retracted, either of which positions provides a safe condition for opening of the locks for attachment decoupling. In other words, sufficient hydraulic pressure is communicated to the retract side of the locks LOCK1,LOCK2 only if the bucket cylinder is fully extended/retracted in which case safe attachment decoupling will result. Alternatively, the control circuits 10',210',210'-F can be used to control the hydraulic circuits 10B,210B, using only the single pressure sensor PS4 as part of the circuits 10',210',210'F.

The invention has been described with reference the preferred embodiments. Modifications and alterations will occur to those of ordinary skill in the art, and it is intended that the invention be construed as including all such modifications and alterations.

The invention claimed is:

1. A hydraulic control circuit for an attachment coupling system, said control circuit comprising:

an input flow path for receiving a supply of pressurized fluid;

first and second actuator flow paths for supplying fluid to respective first and second input/output locations of a first hydraulic actuator associated with an attachment coupler;

a return flow path for supplying pressurized fluid to a reservoir;

a first control valve connected to said input flow path, said return flow path, and said first and second actuator flow paths, said first control valve selectively positionable in at least first and second states in response to a first electrical control signal wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path;

a pressure sensor for sensing fluid pressure supplied to an associated attachment positioning cylinder, said pressure sensor adapted to output an electrical pressure signal that changes state when said fluid pressure supplied to the associated attachment positioning cylinder exceeds a safety threshold;

an electronic control system operatively connected to said pressure sensor and said first control valve, wherein said electronic control system outputs said first control signal to said first control valve to change said first control valve from said first state to said second state only after said electrical pressure signal output by said pressure sensor to said electronic control system indicates that said safety threshold is satisfied.

2. The hydraulic control circuit as set forth in claim 1, further comprising a first user input switch operatively connected to said electronic control system, wherein said electronic control system outputs said first control signal only in response to actuation of said first user input switch.

3. The hydraulic control circuit as set forth in claim 2, wherein said electronic control system outputs said first control signal only in response to actuation of said first user input switch for at least a select user input duration.

4. The hydraulic control circuit as set forth in claim 3, wherein said electronic control system monitors said electrical pressure signal for a select pressure signal duration and requires a continuous uninterrupted state for said electrical pressure signal during said select pressure signal duration before outputting said first control signal.

5. The hydraulic control circuit as set forth in claim 4, wherein said electronic control system ignores a change in said electrical pressure signal while outputting said first control signal.

6. The hydraulic control circuit as set forth in claim 1, wherein said input flow path and the associated attachment positioning cylinder are separate and have unrelated fluid pressure.

7. The hydraulic control circuit as set forth in claim 6, wherein said input flow path is fed directly from a pump.

8. The hydraulic control circuit as set forth in claim 1, wherein said input flow path is in communication with the associated attachment positioning cylinder so that fluid pressure in said input flow path is related to fluid pressure supplied to the associated attachment positioning cylinder, and wherein said pressure sensor is located to sense fluid pressure in said input flow path.

9. The hydraulic control system as set forth in claim 1, further comprising at least one audible alarm operatively connected to said electronic control system, wherein said electronic control system activates said audible alarm whenever said electronic control system outputs said first control signal.

10. The hydraulic control system as set forth in claim 3, further comprising at least one audible alarm operatively connected to said electronic control system, wherein said electronic control system activates said audible alarm whenever said electronic control system outputs said first control signal.

11. The hydraulic control system as set forth in claim 10, wherein said electronic control system receives electrical feedback from said audible alarm to verify activation of said audible alarm when said electronic control system outputs said first control signal.

12. The hydraulic control system as set forth in claim 11, wherein said electronic control system does not send said first control signal if said electrical feedback from said audible alarm indicates malfunction of said audible alarm.

13. The hydraulic control system as set forth in claim 3, wherein said electronic control system comprises a control box including a microprocessor that is operatively connected to and receives input from said first user switch and said pressure sensor.

14. The hydraulic control system as set forth in claim 1, further comprising:

third and fourth actuator flow paths for supplying fluid to respective first and second input/output locations of a second hydraulic actuator associated with an attachment coupler;

a second control valve connected to said input flow path, said return flow path, and said third and fourth actuator flow paths, said second control valve selectively positionable in at least first and second states in response to a second electrical control signal wherein: (i) in said first state, said second control valve connects said input flow path to said third actuator flow path and connects said return flow path to said fourth actuator flow path; and, (ii) in said second state, said first control valve connects said input flow path to said fourth actuator flow path and connects said return flow path to said third actuator flow path;

wherein said electronic control system outputs said second control signal to said second control valve to change said second control valve from said first state to said second state only after said electrical pressure signal output by said pressure sensor to said electronic control system indicates that said safety threshold is satisfied.

15. The hydraulic control circuit as set forth in claim 14, further comprising a second user input switch operatively connected to said electronic control system, wherein said electronic control system outputs said second control signal only in response to actuation of said second user input switch.

16. A method for controlling an attachment coupling system, said method comprising:

pressurizing a first hydraulic actuator of an attachment quick coupler with hydraulic fluid in a first orientation to engage an attachment coupling mechanism connected to the hydraulic actuator; and, sensing hydraulic pressure in a second hydraulic actuator that is used to position the attachment quick coupler;

pressurizing the first hydraulic actuator with hydraulic fluid in a second orientation that is opposite said first orientation to disengage the attachment coupling mechanism connected to the hydraulic actuator only after said hydraulic pressure in said second hydraulic actuator satisfies a threshold pressure value.

17. The method as set forth in claim 16, wherein said step of sensing hydraulic pressure is performed by a pressure sensor that outputs an electrical signal that changes state when said pressure sensor senses said threshold pressure value.

18. The method as set forth in claim 17, wherein said step of sensing hydraulic pressure comprises:

monitoring the electrical signal output by the pressure sensor;

requiring a continuous uninterrupted change of state of the electrical signal for a select duration before pressurizing the first hydraulic actuator with hydraulic fluid in the second orientation.

* * * * *